US011691800B2

(12) United States Patent
Sanders et al.

(10) Patent No.: US 11,691,800 B2
(45) Date of Patent: Jul. 4, 2023

(54) TRANSPORTABLE ACTIVE COOLING CONTAINER

(71) Applicant: Thaddeus Medical Systems, Inc., Rochester, MN (US)

(72) Inventors: Russell Sanders, Minnetonka, MN (US); William Mohs, Christchurch (NZ); Michael Humphries, Wellington (NZ); Stephen Joseph Scully, Jr., Rochester, MN (US)

(73) Assignee: Thaddeus Medical Systems, Inc., Rochester, MN (US)

( * ) Notice: Subject to any disclaimer, the term of this patent is extended or adjusted under 35 U.S.C. 154(b) by 321 days.

(21) Appl. No.: 16/875,610

(22) Filed: May 15, 2020

(65) Prior Publication Data

US 2020/0361690 A1 Nov. 19, 2020

Related U.S. Application Data

(60) Provisional application No. 62/848,836, filed on May 16, 2019.

(51) Int. Cl.
*B65D 81/18* (2006.01)
*F25D 11/00* (2006.01)
(Continued)

(52) U.S. Cl.
CPC ..... *B65D 81/18* (2013.01); *B65D 81/022* (2013.01); *F25D 11/003* (2013.01);
(Continued)

(58) Field of Classification Search
CPC ..... B65D 81/18; B65D 81/022; F25D 11/003; F25D 29/003; F25D 2400/02; F25D 2700/12
See application file for complete search history.

(56) References Cited

U.S. PATENT DOCUMENTS 2,926,504 A * 3/1960 Hellinger ..... F25D 11/00 62/331
5,983,655 A * 11/1999 Kistner ..... G05D 23/1909 62/213
(Continued)

FOREIGN PATENT DOCUMENTS

CN 107255387 A * 10/2017 ..... F25D 21/006
IE 61085 B1 * 9/1994
(Continued)

OTHER PUBLICATIONS

Translated_Yoshiaki (Year: 2010).*
(Continued)

*Primary Examiner* — Elizabeth J Martin
*Assistant Examiner* — Samba Nmn Gaye
(74) *Attorney, Agent, or Firm* — Schwegman Lundberg & Woessner, P.A.

(57) ABSTRACT

A transportable enclosure can include a housing, a power source, a container, an evaporator, a condenser, a compressor, and a controller. The container can be configured to receive a temperature sensitive item therein. The evaporator can be disposed at least partially around the container. The condenser can be positioned near a wall of the housing and can be configured to reject heat from the evaporator to an ambient environment through the wall of the housing.

14 Claims, 25 Drawing Sheets

(51) Int. Cl.
*F25D 29/00* (2006.01)
*B65D 81/02* (2006.01)

(52) U.S. Cl.
CPC ..... *F25D 29/003* (2013.01); *F25D 2400/02* (2013.01); *F25D 2700/12* (2013.01)

(56) References Cited

U.S. PATENT DOCUMENTS

| | | | | |
|---|---|---|---|---|
| 7,041,941 | B2 | 5/2006 | Faries, Jr. et al. | |
| 7,276,675 | B2 | 10/2007 | Faries, Jr. et al. | |
| 7,307,245 | B2 | 12/2007 | Faries, Jr. et al. | |
| 7,417,205 | B2 | 8/2008 | Faries, Jr. et al. | |
| 8,282,895 | B2 | 10/2012 | Miller et al. | |
| 2006/0204950 | A1 | 9/2006 | Hercil et al. | |
| 2007/0240442 | A1* | 10/2007 | Costanzo | F25B 27/005 62/235.1 |
| 2010/0287963 | A1 | 11/2010 | Billen et al. | |
| 2011/0248038 | A1* | 10/2011 | Mayer | F25D 3/06 220/592.2 |
| 2012/0041577 | A1* | 2/2012 | Cho | F25D 29/00 707/769 |
| 2012/0210677 | A1 | 8/2012 | Proskin | |
| 2012/0285180 | A1 | 11/2012 | Wilkinson et al. | |
| 2014/0216098 | A1* | 8/2014 | Heinrich | F25D 29/003 62/448 |
| 2019/0274925 | A1* | 9/2019 | Vlahinos | B65D 25/108 |
| 2020/0132356 | A1* | 4/2020 | Tang | F25D 23/02 |

FOREIGN PATENT DOCUMENTS

| | | | | | |
|---|---|---|---|---|---|
| JP | 2008101869 | A | * | 5/2008 | F25D 17/062 |
| JP | 2010236804 | A | * | 10/2010 | |
| JP | 2014043969 | A | * | 3/2014 | |
| JP | 2017122521 | A | * | 7/2017 | |
| KR | 19990019094 | U | * | 5/1999 | |
| KR | 100373089 | B1 | * | 2/2003 | |
| KR | 200467801 | Y1 | * | 7/2013 | |

OTHER PUBLICATIONS

Translated_Kim (Year: 1999).*
Translated_Ming (Year: 2017).*
Translated_Jun (Year: 2004).*
Translated_Tomomasa (Year: 2017).*
Translated_ (Year: 2008).*
Translated_Yuichi (Year: 2014).*
Translated_Champa (Year: 1994).*
Translated_Kim (Year: 2003).*

* cited by examiner

TRANSPORTABLE ACTIVE COOLING CONTAINER

CLAIM OF PRIORITY

This patent application claims the benefit of priority, under 35 U.S.C. Section 119(e), to Sanders et. al. U.S. Patent Application Ser. No. 62/848,836, entitled "TRANSPORTABLE ACTIVE COOLING CONTAINER," filed on May 16, 2019, which is hereby incorporated by reference herein in its entirety.

BACKGROUND

The present disclosure relates generally to transportation devices for temperature sensitive items. In various circumstances, temperature sensitive products may require transportation. For example, vials of a vaccine or tubes of blood require transport between medical facilities and/or laboratories. Some of the products requiring transport can be damaged by relatively extreme ambient conditions such as high or low temperatures. Such products therefore require a transportable enclosure capable of actively or passively maintaining a temperature range of the product within the enclosure.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

To accommodate transportation of temperature sensitive items, containers having passive or active temperature control can be used. Some transportable enclosures can use active cooling to maintain an internal temperature of the enclosure during transportation of the fluids where ambient air can be used to cool one or more cavities within the enclosure and forced convection can be used to transfer heat between the fluids and the ambient environment. However, the use of only ambient air for cooling may be insufficient to maintain a desired product temperature within the enclosure due to extreme ambient conditions.

The techniques of this disclosure can help provide a solution to these issues such as through use of an active cooling or heating system. The heating/cooling system can be a transportable refrigeration system that includes an evaporator positioned to surround a product carrier, allowing a temperature of the carrier and products therein to be maintained at a setpoint temperature or within a desired range of temperatures.

The above discussion is intended to provide an overview of subject matter of the present patent application. It is not intended to provide an exclusive or exhaustive explanation of the invention. The description below is included to provide further information about the present patent application.

Figure 1A:
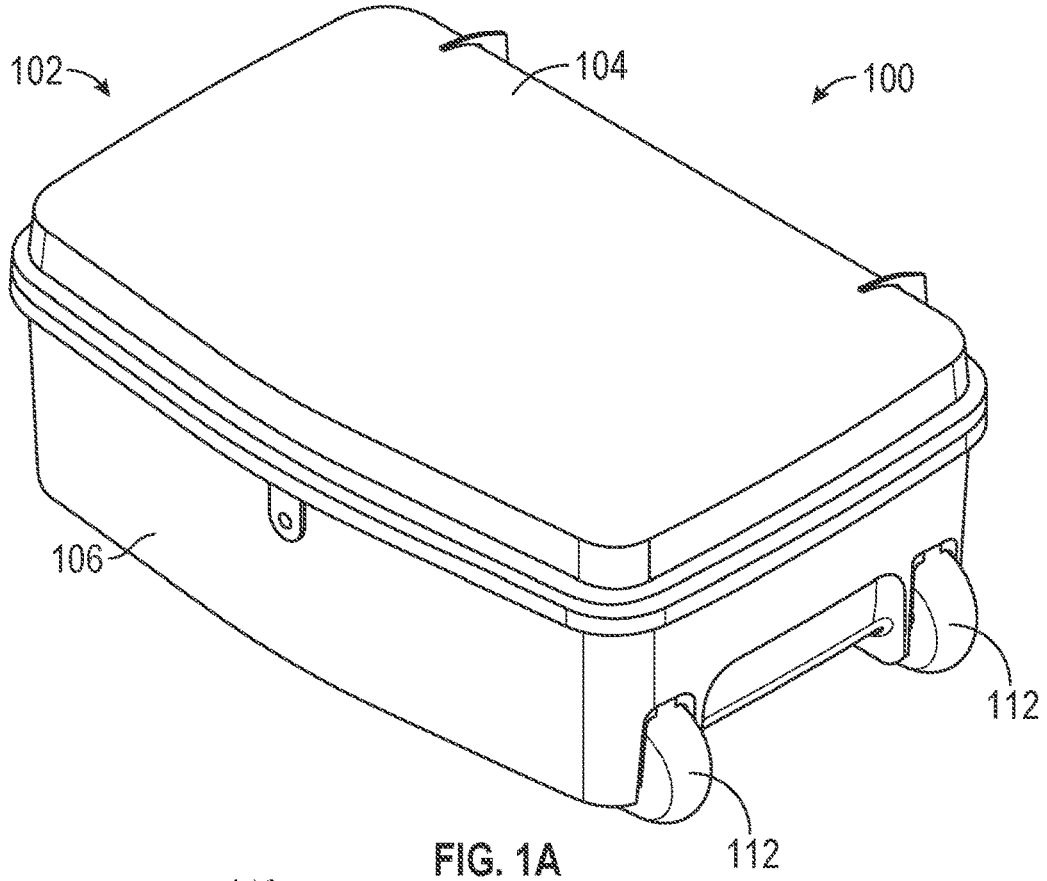
FIG. 1A illustrates an isometric view of a transportable device.
Figure 1B:
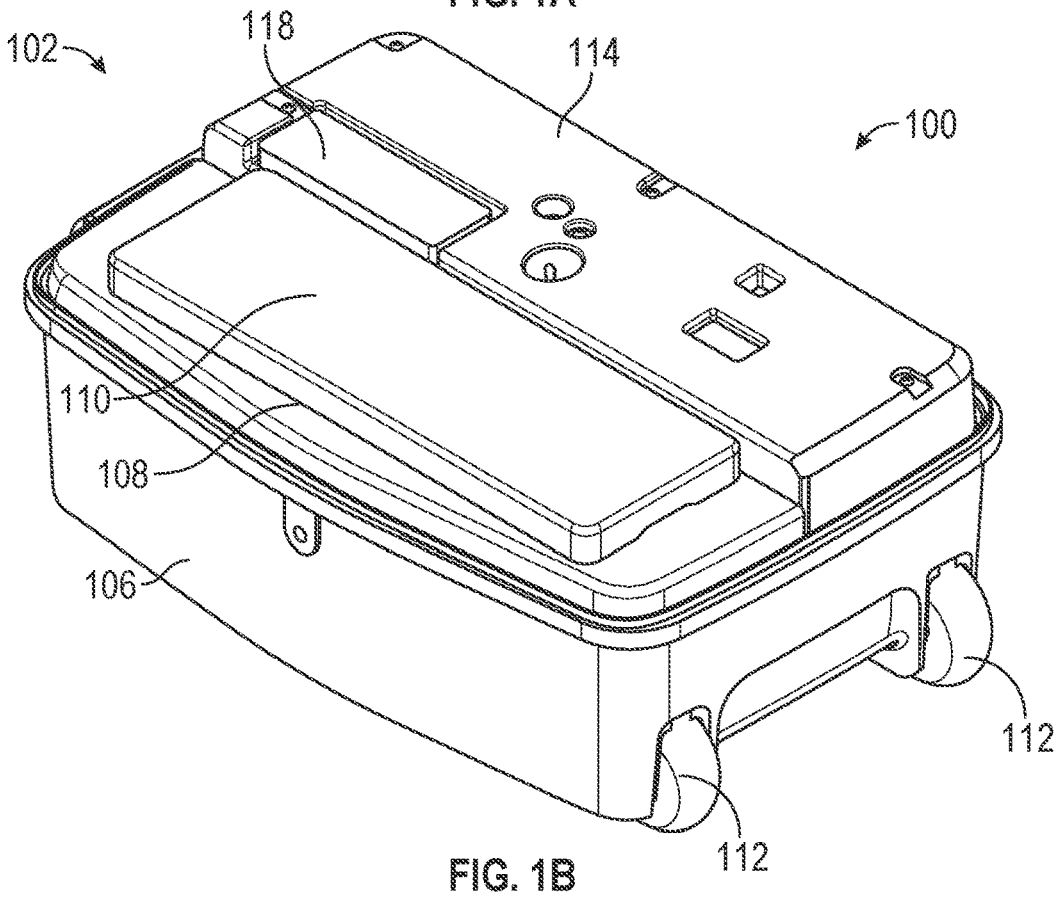
FIG. 1B illustrates an isometric view of a transportable device.
Figure 1C:
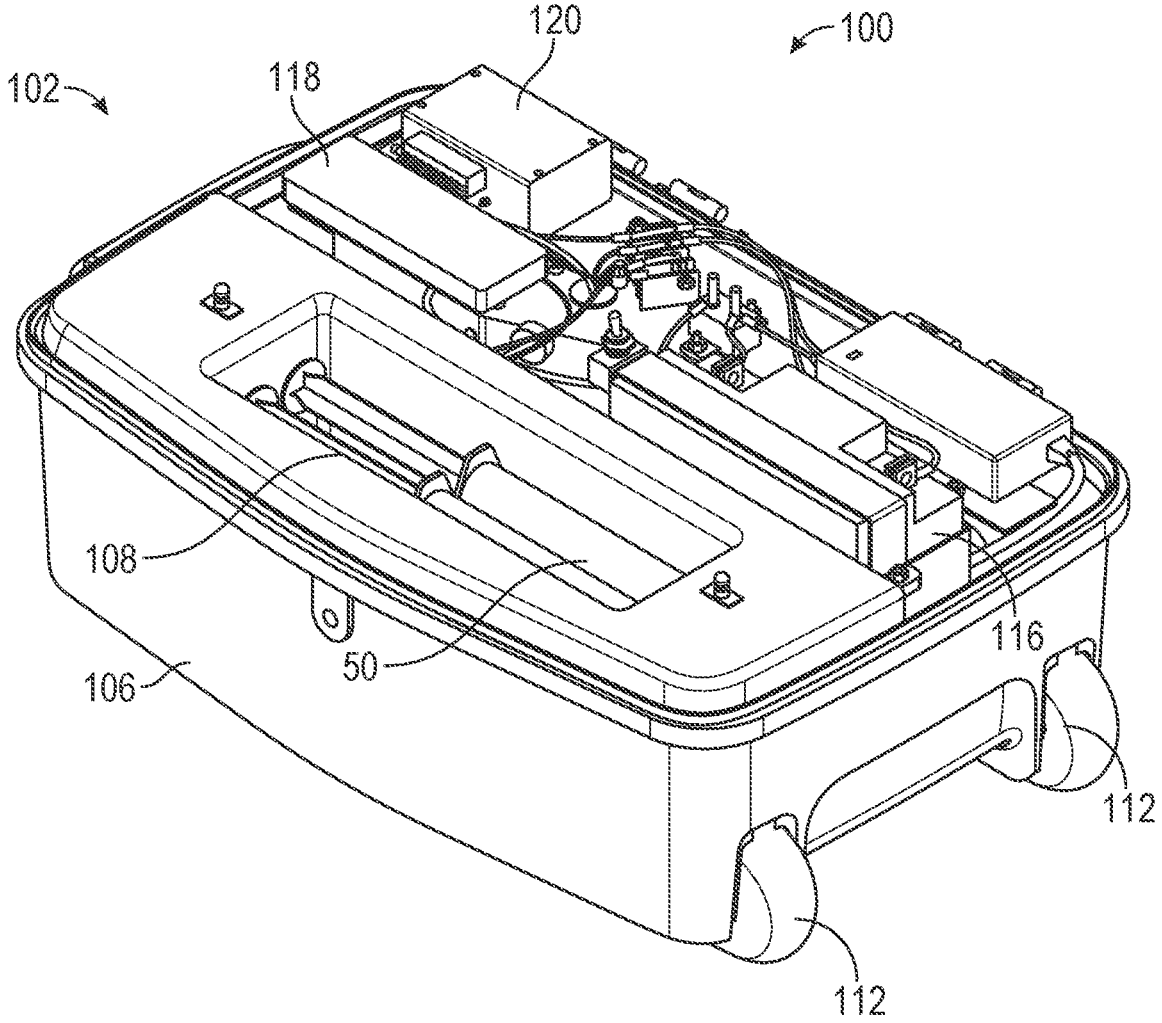
FIG. 1C illustrates an isometric view of a transportable device.

FIG. 1A illustrates an isometric view of a transportable device 100 for actively controlling a temperature of a temperature-sensitive item. FIG. 1B illustrates an isometric view of the transportable device 100. FIG. 1C illustrates an isometric view of the transportable device 100. FIGS. 1A-1C are discussed below together.

The transportable device 100 can include a housing 102 including a lid 104 and a base 106. The device 100 can also include a container 108 (visible in FIGS. 1B and 1C), a container lid 110 (visible in FIG. 1B), wheels 112, and a controls cover 114. Also shown in FIG. 1C are temperature-sensitive items, or samples 50.

The housing 102 can be a rigid or semi-rigid enclosure comprised of materials such as one or more of foams, metals, plastics, ceramics, or the like. The housing 102 can be configured to support and protect the components of the transportable enclosure or device 100. The lid 104 can be releasably securable to the base 106 such as through hinges, clips, clasps, locks, or other fastening devices.

The container 108 can be a rigid or semi-rigid enclosure comprised of materials such as one or more of foams, metals, plastics, ceramics, or the like. The container 108 can be positionable within the housing 102 and can be configured to receive and retain the temperature sensitive items 50 therein. The container lid 110 can be positionable over an open portion (such as a top) of the container 108 to retain items within the container 108 and to help thermally insulate the contents of the container 108.

The wheels 112 can be connected to a bottom or side portion of the housing 102 and can be used (such as together with a handle or handles) to roll the transportable device 100, such as during transportation of the device 100.

The controls cover 114 can help to enclose controls and power components such as a power source 116, a transceiver 118, and a controller 120, as shown in FIG. 1C. These components are discussed in further detail below.

In operation of the transportable device 100, the lid 104 can be removed for positioning of samples 50 within the container 108. The container lid 110 can be secured to the container 108 to help contain the samples 50. The lid 104 can be closed and secured to the base 106. The controller 120 can be operated (such as remotely through an application or such as using a control interface on the housing 102) to enable active temperature control of the container 108. The temperature control can be performed throughout transport of the device 100 until the samples 50 are safely delivered.

Figure 2A:
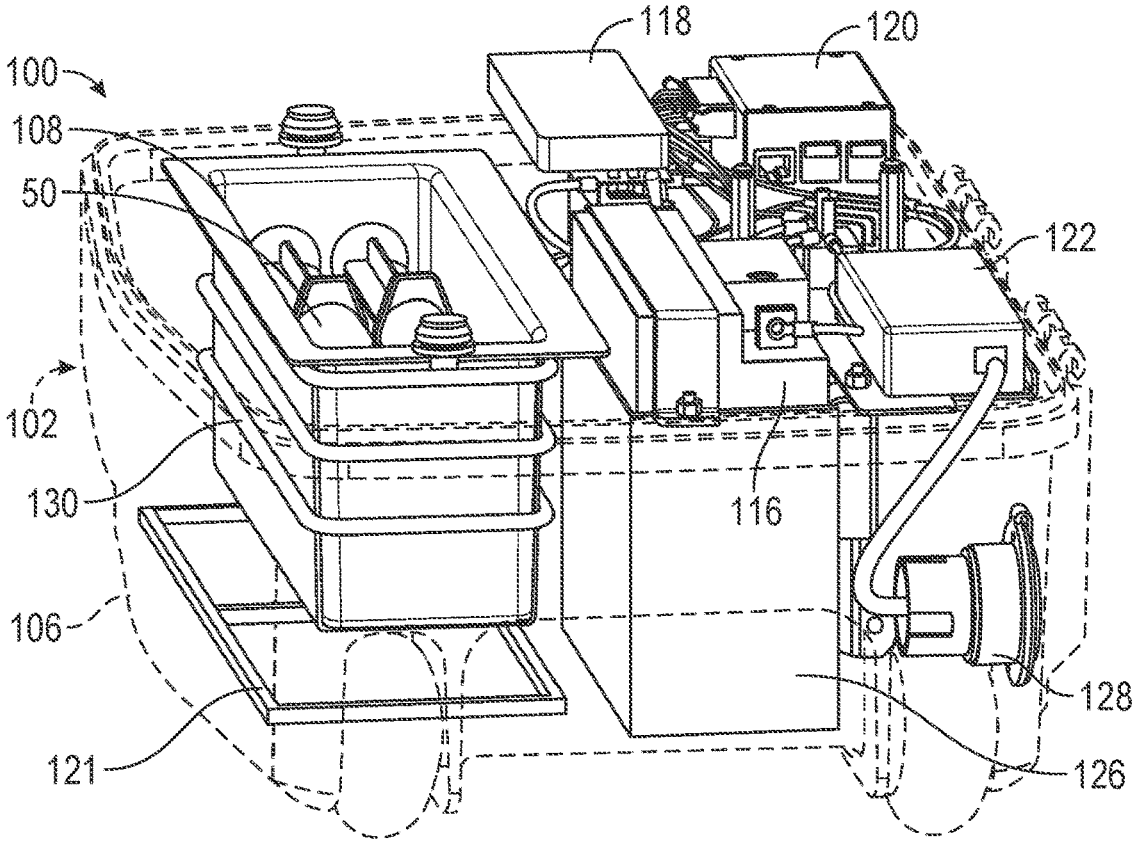
FIG. 2A illustrates an isometric view of a portion of a transportable device.
Figure 2B:
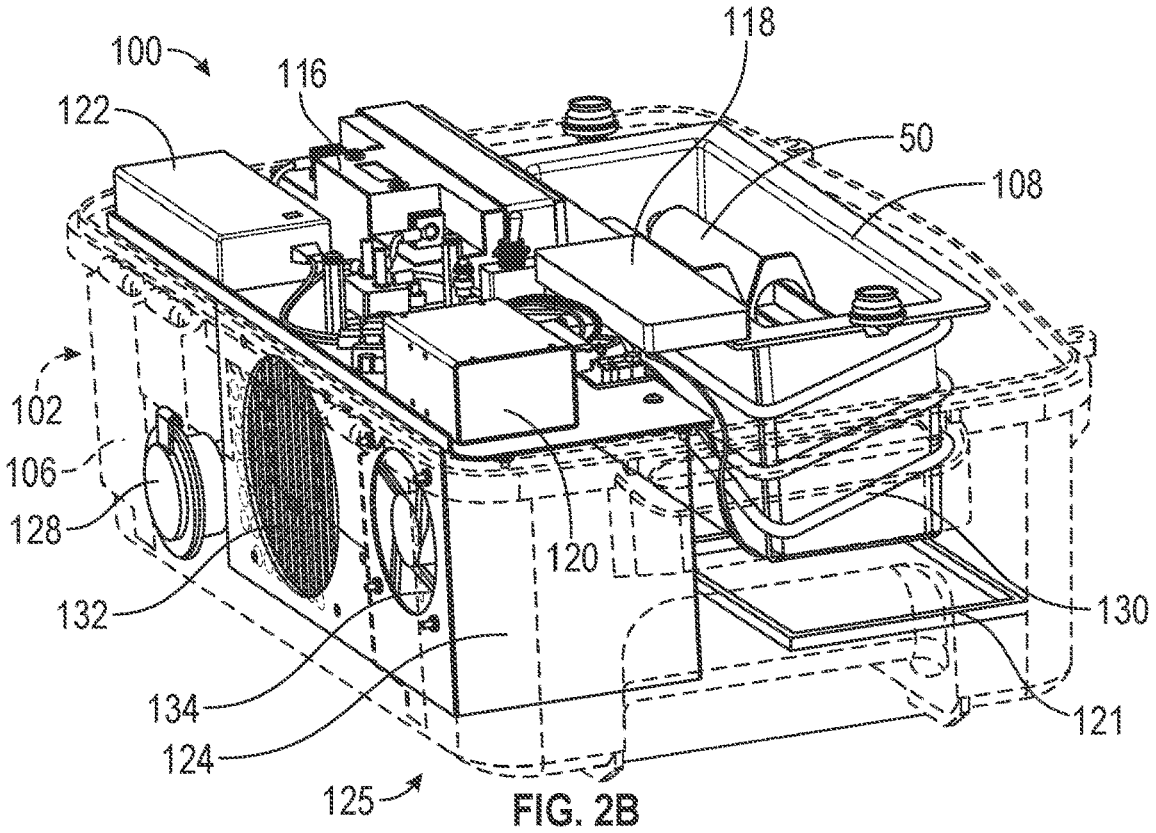
FIG. 2B illustrates an isometric view of a portion of a transportable device.

FIG. 2A illustrates an isometric view of a portion of the transportable device 100. FIG. 2B illustrates an isometric view of a portion of the transportable device 100. FIGS. 2A and 2B are discussed below together.

The transportable device 100 can be consistent with FIGS. 1A-1C discussed above. FIGS. 2A-2B show additional components of the transportable device 100. For example, FIGS. 2A and 2B show a transformer 122, a mechanical housing 124, a cooling system 125, a power source housing 126, and a charging connector 128. The cooling system 125 can include an evaporator 130, a condenser 132, and a fan 134. In some examples, the cooling system 125 can include a reversing valve and can be operated as a heat pump to provide heat to the container 108 and its contents, when required to maintain the desired temperature.

The power source 116 can be a battery secured to the power source housing 126 and optionally to the mechanical housing 124. In both examples, the power source 116 can be connected to the housing 102. The power source 116 can be any type of capacitor or battery configured to store and controllably release a charge to power components of the transportable enclosure or device 100, such as the fan 134, the controller 120, a compressor, and a heater. In one example, the power source 116 can be a lithium iron phosphate battery operating at 12 Volts, but the power source 116 can operate at 24 Volts or 48 Volts.

The charging connector 128 can be electrically connected to the transformer 122 to connect the transformer to an alternative power source, such as a ground-fault-interrupted outlet (such as a 110/120 Volt outlet). The charging connector 128 can thereby allow the power source 116 to be charged or the components of the device 100 to run off the alternative power source.

The cooling system 125 can include the evaporator 130, the condenser 132, and the fan 134, as well as a compressor, one or more sensors (such as pressure and/or temperature sensors), refrigerant lines, cooling fan(s), etc. The cooling system 125 can be supported, at least in part, by the mechanical housing 124. For example, the condenser 132 and the condenser fan 134 can be connected to and supported by the mechanical housing 124. The mechanical housing 124 can be a rigid or semi-rigid enclosure comprised of materials such as one or more of foams, metals, plastics, ceramics, or the like.

The evaporator 130 and the condenser 132 can be coils configured to exchange heat between refrigerant and other sources. For example, the evaporator 130 can exchange heat with the container 108 and the condenser 132 can exchange heat with ambient air. The evaporator 130 and the condenser can be any type of heat exchanger such as a coiled exchanger, a fin-and-tube heat exchanger, a microchannel heat exchanger, or the like.

The condenser 132 can be positioned near a wall of the housing 102 and can be configured to reject heat from the evaporator to an ambient environment through the wall of the housing 102. The compressor can be powered by the power source to circulate refrigerant between the evaporator 130 and the condenser 132 to cool the container 108 and the samples 50 to maintain a desired temperature. The condenser fan 134 can be optionally included and can be located within the housing 102. The condenser fan 134 can be powered by the power supply 116 to deliver ambient air to the condenser 132.

In some examples, the condenser fan 134 can be a variable speed fan where the controller 120 can control the speed of the condenser fan 134 to maintain a condensing temperature or a desired capacity. The condenser fan 134 can also be configured to be water resistant. For example, the condenser fan 134 can have an Ingress Protection rating of 68 or 69k.

The controller 120 can be a programmable controller, such as a single or multi-board computer, a direct digital controller (DDC), or a programmable logic controller (PLC). In other examples the controller 120 can be any computing device, such as a handheld computer, for example, a smart phone, a tablet, a laptop, a desktop computer, or any other computing device including a processor and wireless communication capabilities. The controller 120 can be powered by the power source 116 and can be configured to operate the compressor and the fan 134.

FIGS. 2A and 2B also show a frame or support 121 which can be a structure for receiving and supporting a panel (such as the insulated panels discussed further below). The frame 121 can also be configured to accept foam insulation that can be positioned below the container 108 to help insulate the container 108 and to help absorb shocks and forces applied to the container 108.

Figure 3A:
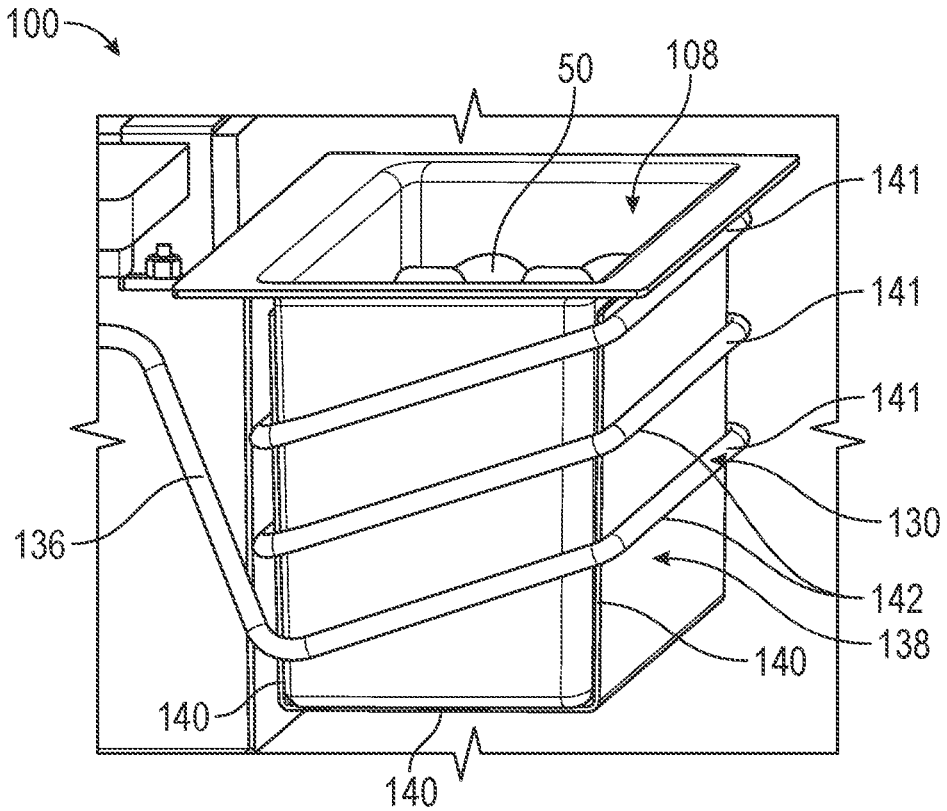
FIG. 3A illustrates an isometric view of a portion of a transportable device.
Figure 3B:
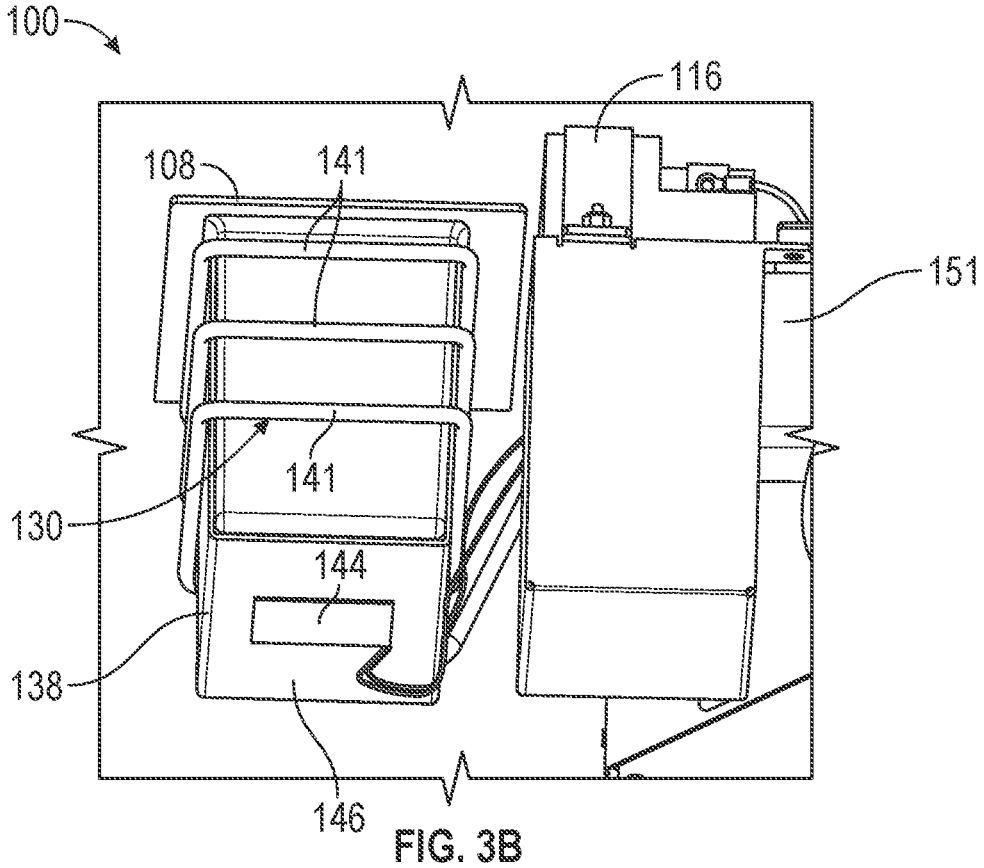
FIG. 3B illustrates an isometric view of a portion of a transportable device.

FIG. 3A illustrates an isometric view of a portion of the transportable device 100. FIG. 3B illustrates an isometric view of a portion of the transportable device 100. FIGS. 3A and 3B are discussed below together.

FIGS. 3A and 3B show that the evaporator 130 can be a finless tube heat exchanger located at least partially around the container 108. The evaporator 130 can extend around the container 108 such that the evaporator 130 makes multiple passes around the container 108 before connecting to a suction line 136, which can be connected to the compressor of the cooling system 125. The evaporator 130 can cool the container 108 using refrigerant via conduction. In some examples, an evaporator fan can be included in the transportable device 100 to help provide cooling to the container via convection using the evaporator 130.

FIGS. 3A and 3B also show a heat spreader 138, which can be comprised of thermally conductive materials, such as one or more of aluminum, copper, silver, gold, platinum, or the like. The heat spreader 138 can be shaped to receive the container 108 therein such that the heat spreader 138 can at least partially surround the container 108. The heat spreader 138 can be in contact with one or more sides of the container 108. Contact points between the container 108 and the heat spreader 138 can be filled with thermal paste 140 or another conductive substance to help improve heat transfer between the container 108 and the heat spreader 138.

The heat spreader 138 can be shaped complementary to the container 108. For examples, the heat spreader 138 be U-shaped in some examples, and can have other shapes in other examples such that the heat spreader 138 can contact 1, 2, 3, 4, 5, 6, or more surfaces of the container 108. In some examples, the evaporator 130 can be brazed to the heat spreader 138, such as at braze points 142. Tubes 141 of the evaporator 130 can be brazed to the heat spreader 138 along an entirety of a length of where the tubes 141 overlap the heat spreader 138 to help improve heat transfer between the tubes 141 and the heat spreader 138.

In some examples, the container 108 can be made of plastic, brass, or other materials having a relatively high thermal transmissivity to help allow the cooling system 125 and the heat spreader 138 to more effectively transfer heat to the payload or samples 50 within the container 108.

A heater 144 can be optionally included and can be located near the container 108. In some examples, the heater 144 can be connected to the heat spreader 138, such as to a bottom portion 146 of the heat spreader 138. The heater 144 can be a resistive heater, such as a patch heater or the like. The heater 144 can be powered by the power source 116 such as to provide heat to the container 108 and therefore to the samples 50 therein. In some examples, the heater 144 can have a positive temperature coefficient and can be configured to have a duty cycle of less than 100%, such as 75%, 80%, 85%, or the like. The controller 120 can be configured to operate the heater 144 to maintain the desired temperature within the container 108.

Figure 4A:
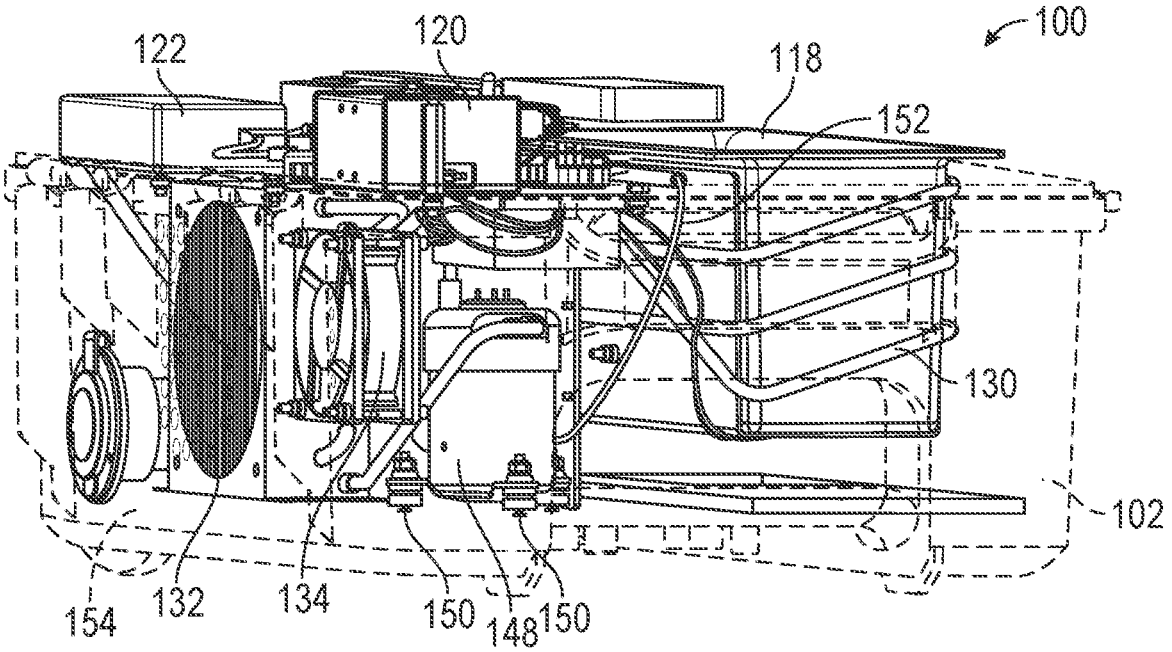
FIG. 4A illustrates an isometric view of a portion of a transportable device.
Figure 4B:
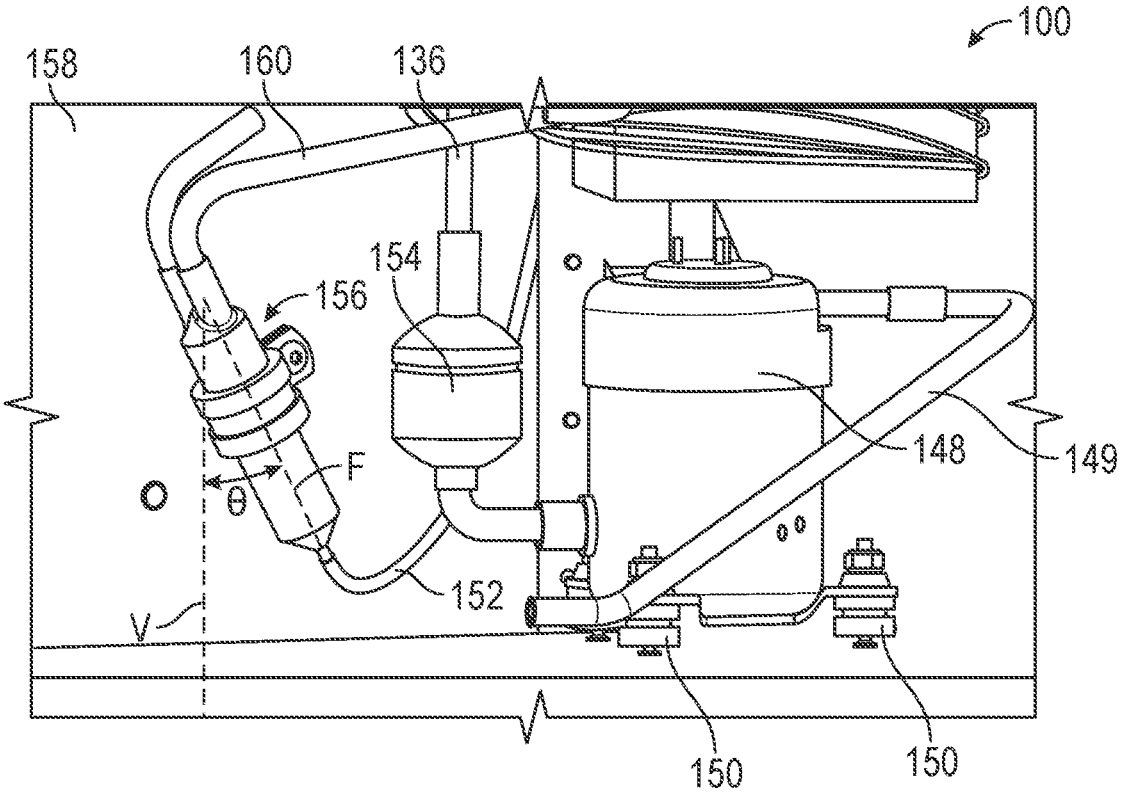
FIG. 4B illustrates an isometric view of a portion of a transportable device.
Figure 4C:
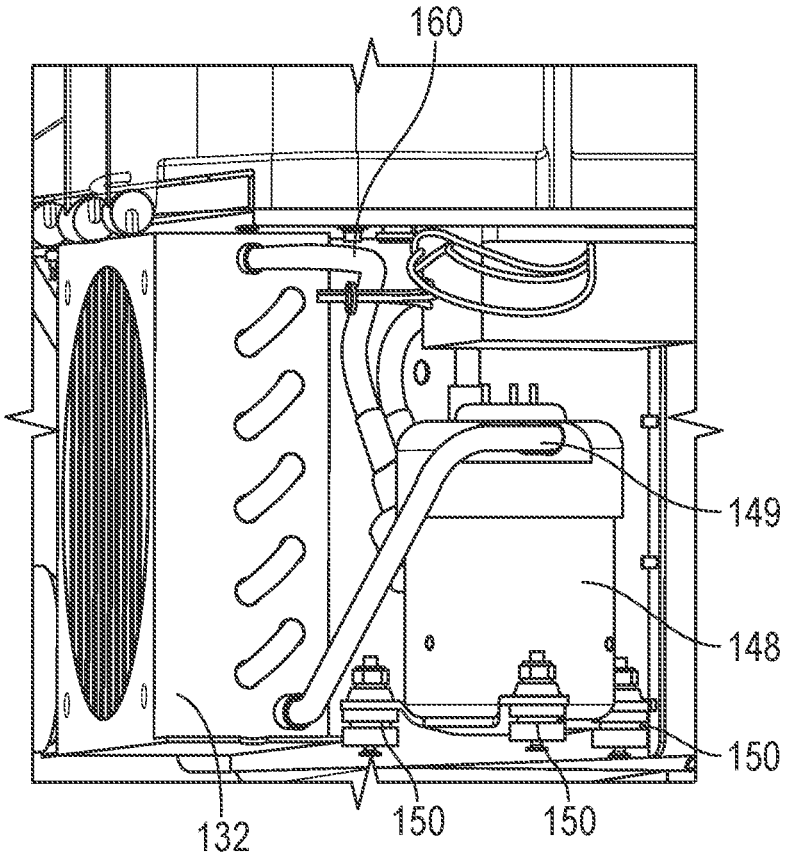
FIG. 4C illustrates an isometric view of a portion of a transportable device.

FIG. 4A illustrates an isometric view of a portion of the transportable device 100. FIG. 4B illustrates an isometric view of a portion of the transportable device 100. FIG. 4C illustrates an isometric view of a portion of the transportable device 100. FIGS. 4A-4C are discussed together below.

The mechanical housing 124 is not visible in FIGS. 4A-4C to more clearly show components of the cooling system 125. For example, FIGS. 4A and 4C show a compressor 148 that can be connected to the mechanical housing 124 by mounts 150 (which can be rubber-in-shear mounts, for example). The compressor 148 can be fluidly connected to the condenser coil 132 by a discharge line 149 and can be connected to the evaporator via the suction line 136.

The compressor 148 can be a rotary compressor, a reciprocating compressor, a scroll compressor, or the like. Use of a rotary compressor can help to reduce compressor failure caused by liquid slugging, which can be useful in the transportable device 100 where the device 100 is subject to tipping and large temperature changes due to movement of the device 100 into and out of buildings and ambient environments, which can increase a likelihood of liquid slugging. In some examples, the compressor 148 can be a variable speed compressor where the controller 120 can control the speed of the compressor 148 to maintain an evaporation temperature, a desired capacity, or to maintain a temperature of the container 108.

In some examples, an accelerometer 151 (shown in FIG. 3B) can be included to sense a gravitational force. The accelerometer 151 can be connected to the controller 120 and the controller 120 can use a signal from the accelerometer 151 to determine when the device 100 is tipped or rotated with respect to the gravitational force. The controller 120 can disable the compressor 148 if a threshold angle is surpassed, such as 30 degrees, 45 degrees, or the like.

FIG. 4A also shows a capillary tube 152 connected to the evaporator 130, which can act as an expansion device for the cooling system 125. In other examples, a thermal expansion valve, or electronic expansion valve can be used. FIGS. 4A and 4B also show that the condenser 132 and the fan 134 can be mounted next to, adjacent, or near a wall 154 of the housing 102, such as an external wall of the housing 102. Positioning of the condenser 132 and the fan 134 at or near the wall 154 can help promote air flow through the condenser 132, as discussed in further detail below.

FIG. 4B also shows a suction accumulator, which can be connected to the suction line 136 upstream of the compressor 148, and can help to counteract refrigerant migration in the refrigeration system of the cooling system 125, which can occur due to movement of the transportable device 100, such as during transportation of the transportable device 100.

FIG. 4B also shows a filter-drier 156, which can be mounted to a mechanical divider 158. The filter-drier 156 can be connected to the condenser coil 132 via a liquid line 160 and to the evaporator 130 via the capillary tube 152. The filter-drier 156 can be oriented vertically to help supply liquid refrigerant to the capillary tube 152 when the transportable device 100 is tilted with respect to a direction of a force of gravity. For example, the filter-drier 156 can be mounted at an angle Θ defined by a vertical line V of the container 102 and an axis F of the Filter-drier. The angle Θ can be less than 90 degrees to help the filter-drier 156 provide liquid to the capillary line 152. For example, the angle Θ can be between 0 and 90 degrees. In some examples, the angle Θ can be 15 degrees, 30 degrees, 45 degrees, or the like to help the filter-drier 156 provide liquid to the capillary line 152.

Figure 5A:
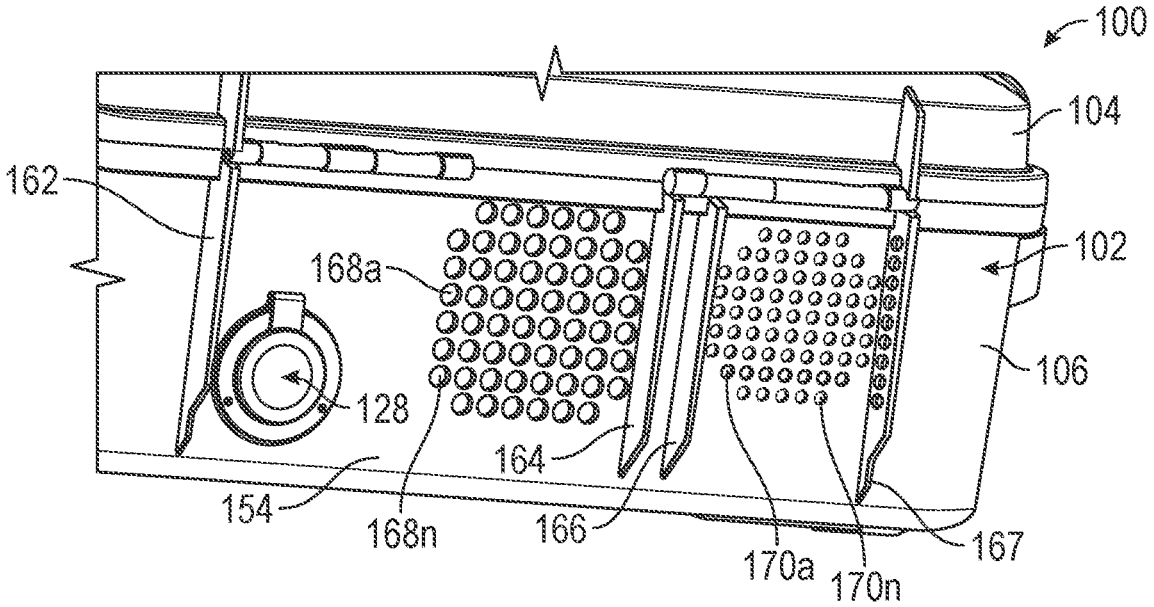
FIG. 5A illustrates an isometric view of a portion of a transportable device.
Figure 5B:
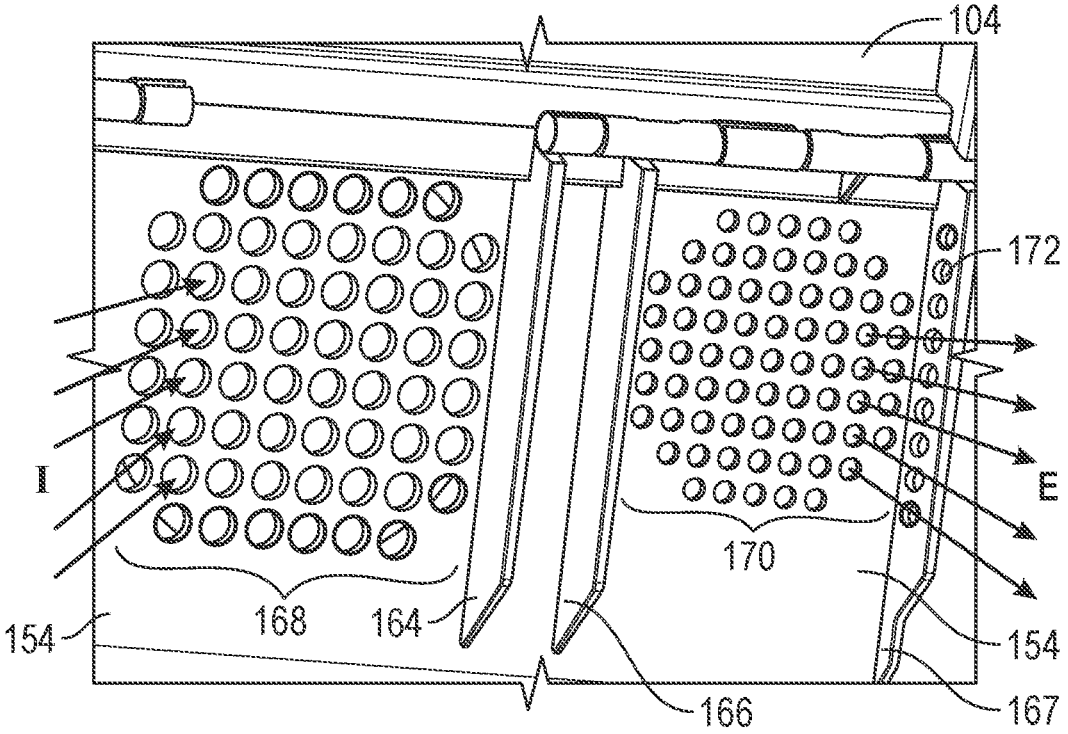
FIG. 5B illustrates an isometric view of a portion of a transportable device.
Figure 5C:
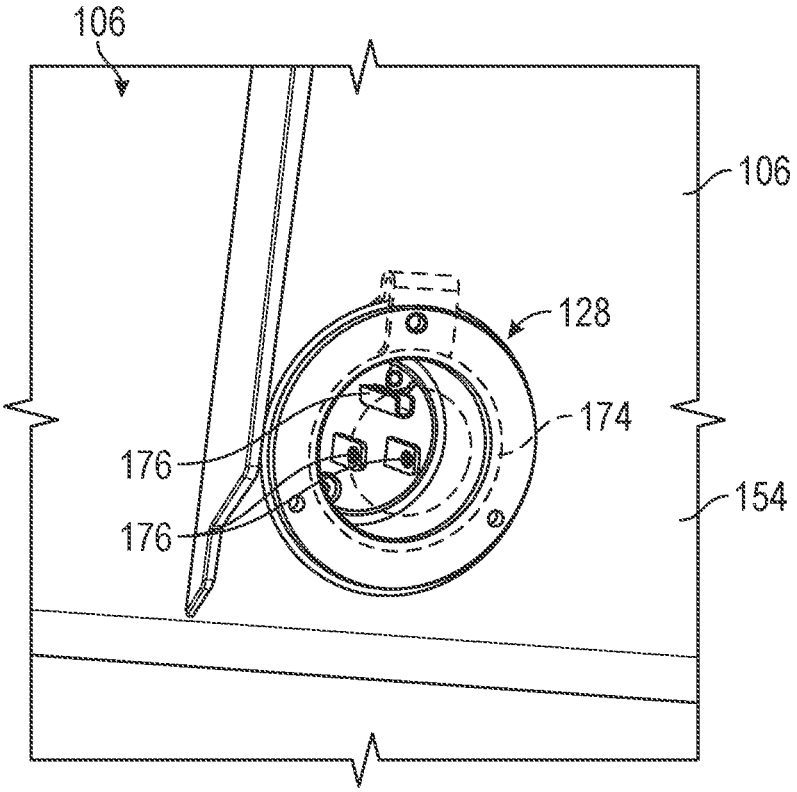
FIG. 5C illustrates an isometric view of a portion of a transportable device.

FIG. 5A illustrates an isometric view of a portion of the transportable device 100. FIG. 5B illustrates an isometric view of a portion of the transportable device 100. FIG. 5C illustrates an isometric view of a portion of the transportable device 100. FIGS. 5A-5C are discussed together below.

FIGS. 5A and 5B show the wall 154 of the base 106 of the housing 102. The wall 154 can include fins 162, 164, 166, and 167 extending outward from the wall. The wall 154 can also include intake bores 168*a*-168*n* and exhaust bores 170*a*-170*n*. The intake bores 168*a*-168*n* can extend through the wall 154 near the condenser coil 132 and the exhaust bores 170*a*-170*n* can extend through the wall 154 near the exhaust or condenser fan 134.

The fins 162-167 (or spacer fins) can extend outward from the wall 154 of the housing 102 and can be configured to engage objects, such as boxes or walls, to help ensure that intake bores 168 and exhaust bores 170 are not adjacent a surface. That is, the fins 162-167 help prevent restriction of airflow through the intake bores 168 and the exhaust bores 170, to help ensure the cooling system 125 can operate to cool the samples 50 during transportation of the transportable device 100.

As shown in FIGS. 5A and 5B, the fins 164 and 166 can be positioned between the intake bores 168 and the exhaust bores 170. Because the fins extend out from the wall 154, the fins 164 and 166 can help to limit exhaust air E from exhausting from the exhaust bores 170 and entering the intake bores 168. That is, the fins 164 and 166 can help to limit condenser air recirculation, which can help ensure the cooling system 125 can operate to cool the samples 50 during transportation of the transportable device 100.

In some examples, the fin 167 can be excluded to help the exhaust air E move away from the intake bores 168 as it exits the exhaust bores 170. In some examples, the fin 167 can include fin bores 172, which can extend through the fin 167 and can help the exhaust air E move away from the intake bores 168 as it exits the exhaust bores 170.

In some examples, the intake bores 168, can extend through the wall 154 at an angle such that intake air I enters the intake bores 168 in a direction away from the exhaust bores 170. Similarly, the exhaust bores 170 can extend through the wall 154 at an angle such that the exhaust air E exits the exhaust bores 170 in a direction away from the intake bores. In other examples, the bores can point in other directions. For examples, the intake bores 168 can extend through the wall 154 at an upward angle to drawn in air from a bottom portion of the wall 154 and the exhaust bores 170 can extend through the wall 154 at an downward angle to exhaust air from a top portion of the wall 154. The angled bores can help limit recirculation of condenser air, which can help to ensure the cooling system 125 can produce sufficient capacity to keep the samples 50 at the desired temperature and to help reduce power consumption.

FIG. 5C shows the charging port 128, which can extend at least partially through the wall 154. The charging port 128 can include a cap 174 configured to cover terminals 176 of the charging port 128. In some examples, the cap 174 can be oriented such that the cap falls closed due to gravitational force when the housing 102 is resting on its base.

Figure 6:
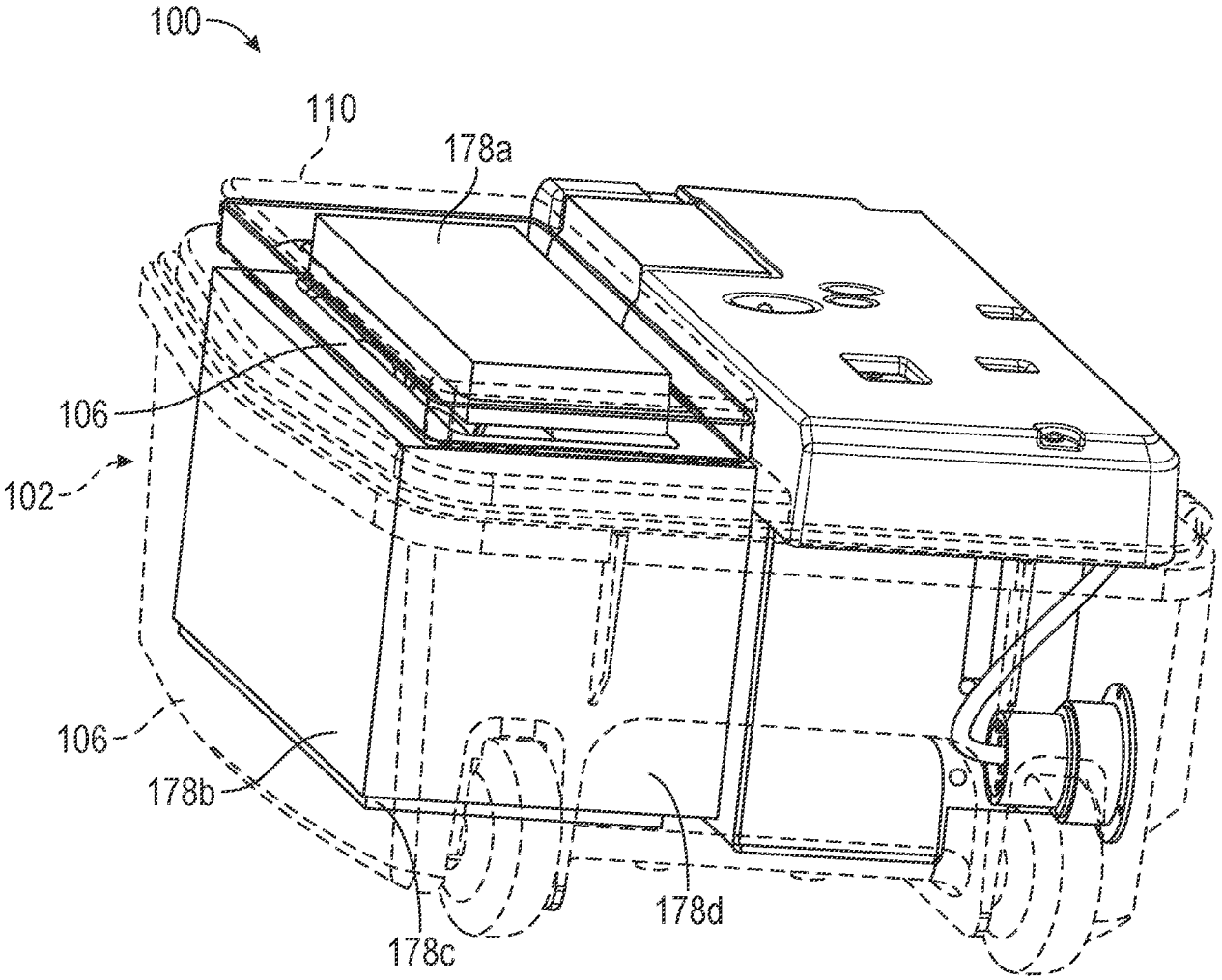
FIG. 6 illustrates an isometric view of a portion of a transportable device.

FIG. 6 illustrates an isometric view of a portion of the transportable device 100. FIG. 6 shows the housing 102 in phantom to help show panels 178*a*-178*d* (collectively referred to as panels 178) that can be positioned around the container 108. For example, the panel 178*a* can be connected to the container lid 110 to cover the opening of the container 108.

The panels 178 can be vacuum insulated panels (VIPs), which can help to thermally insulate the container 108 and its contents, which can help to reduce heating and cooling requirements to maintain the desired temperature of the container 108 and its contents. The panels 178 can also at least partially surround the evaporator 130 and the heater 144.

Figure 7A:
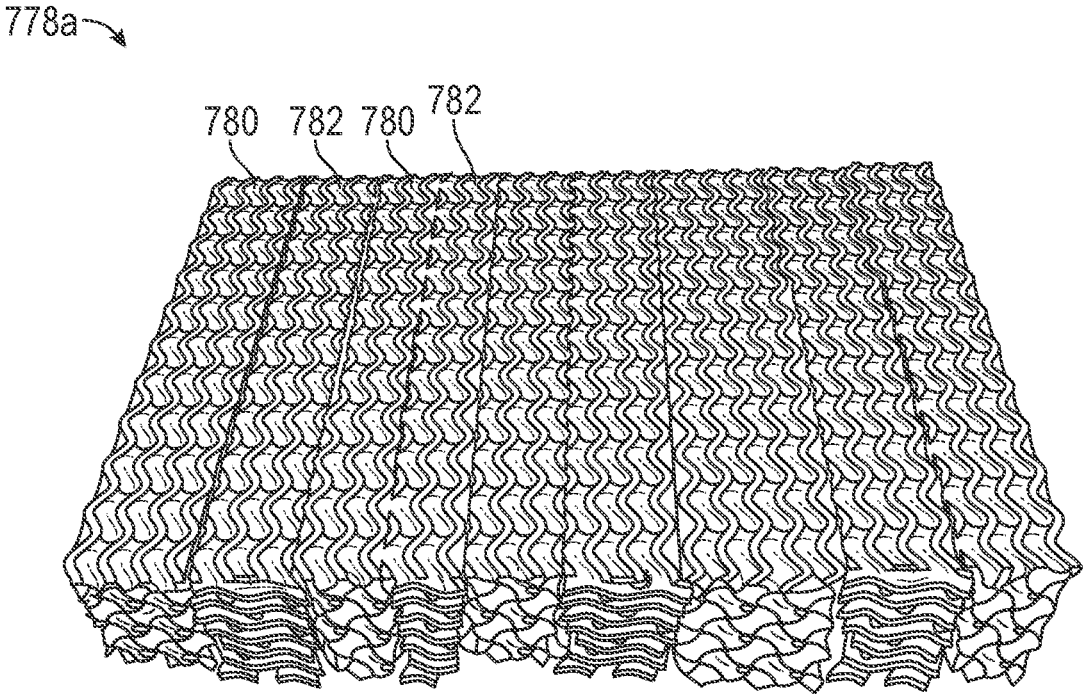
FIG. 7A illustrates a perspective view of a portion of a transportable device.

FIG. 7A illustrates a perspective view of a portion of a panel 778*a* of a transportable device. The panel 778*a* can be similar to the panels 178 discussed above such that the panel 778*a* can be positioned within a housing to help protect and insulate a payload or samples within a transportable container.

The panel 778*a* can include a shock absorber 780 having a first shape defining a first Shore value and a shock absorber 782 having a second shape defining a second Shore value. Use of materials having different Shore values can help to absorb shocks and forces of different intensities and frequencies to help protect the payload or samples within a transportable container.

Figure 7B:
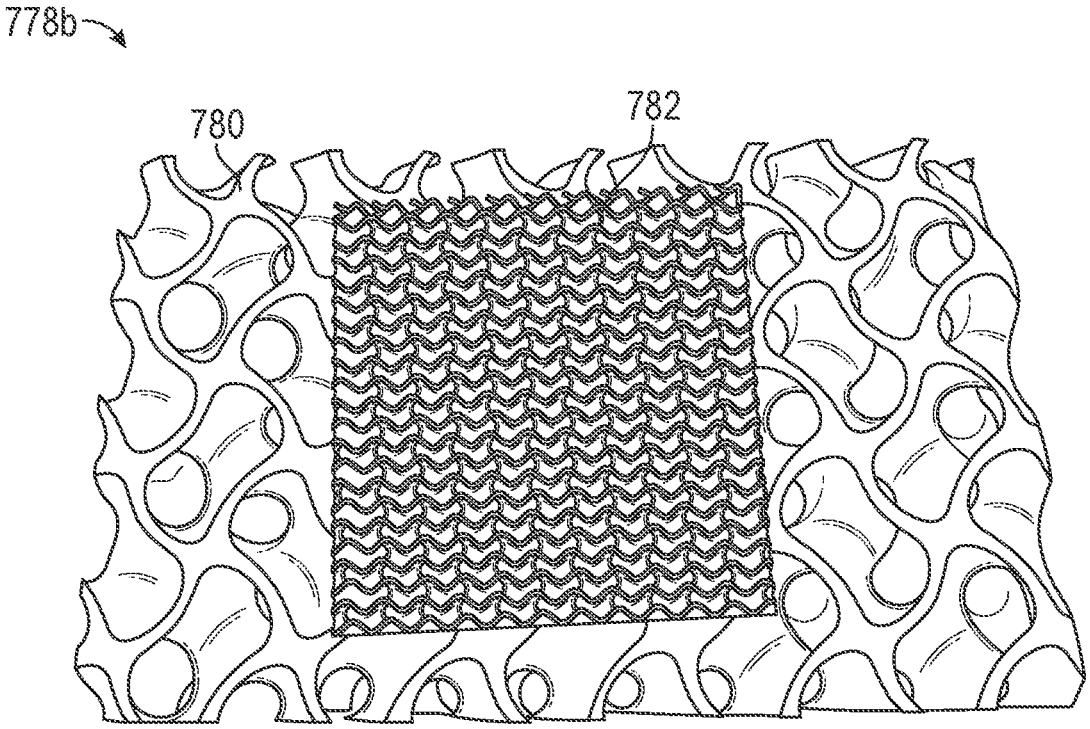
FIG. 7B illustrates a perspective view of a portion of a transportable device.

In some examples, the shock absorbers 780 and 782 can have a shape of a gyroid, which can provide a portion of an "infinite" periodic minimal surface without self-intersection. That is, the gyroid can include or be comprised of layered and substantially parallel ribbons or wavy or undulating corrugations that do not intersect each other. That is, vertical parallel ribbons do not intersect, horizontal parallel ribbons do not intersect, and lateral parallel ribbons do not intersect, however, ribbons may meet at certain points, as shown in FIGS. 7A and 7B.

In some examples, the shock absorber 780 can be a gyroid of a different shape (such as with thinner ribbons) than the shock absorber 782, which can cause the absorbers 780 and 782 to have different shore values. In other examples, the shock absorbers 780 and 782 can have different materials FIG. 7B illustrates a perspective view of a panel 778*b* of a transportable device. FIG. 7B shows how the shock absorbers 780 and 782 can be of different sizes and shapes. For example, the shock absorbers 780 and 782 can each be gyroids where the absorber 780 has ribbons and openings that are much larger than the ribbons and openings of the absorber 782.

Figure 8:
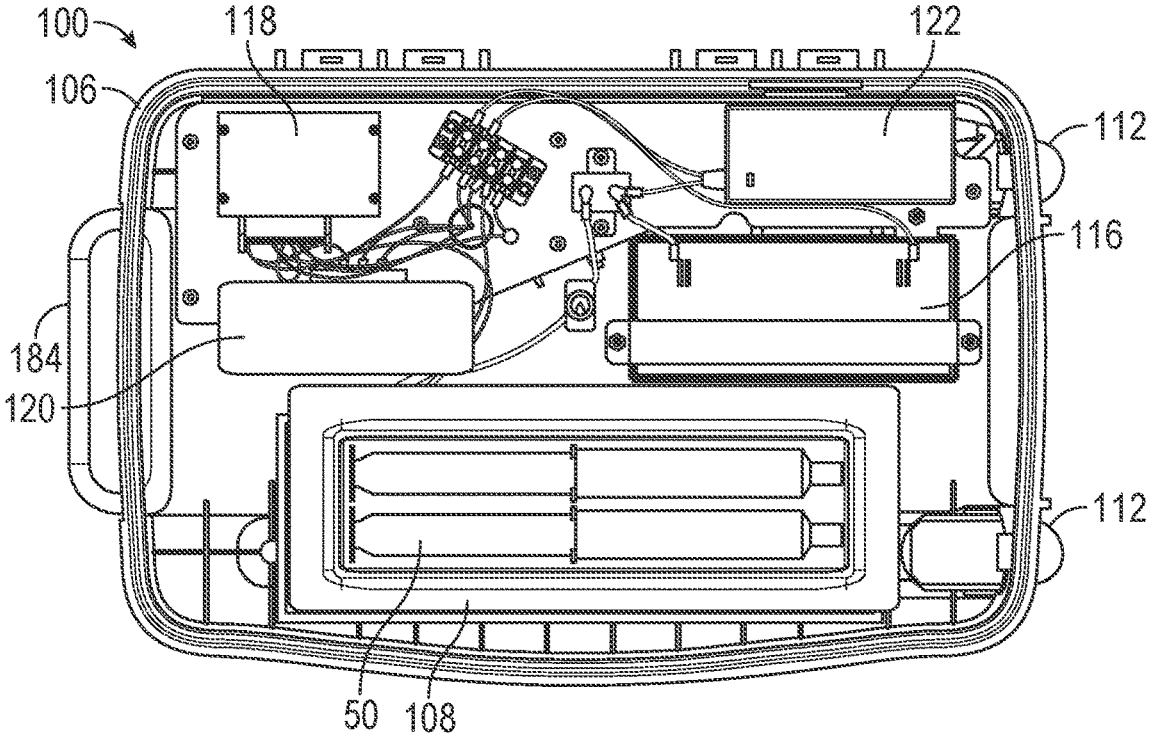
FIG. 8 illustrates an isometric view of a portion of a transportable device.

FIG. 8 illustrates an isometric view of a portion of the transportable device 100. FIG. 8 shows that the samples 50 can be accessed through a top opening of the container 108. FIG. 8 also shows that the base 106 of the housing 102 can include a handle 184, which can be used to roll the transportable device using the wheels 112.

Figure 9:
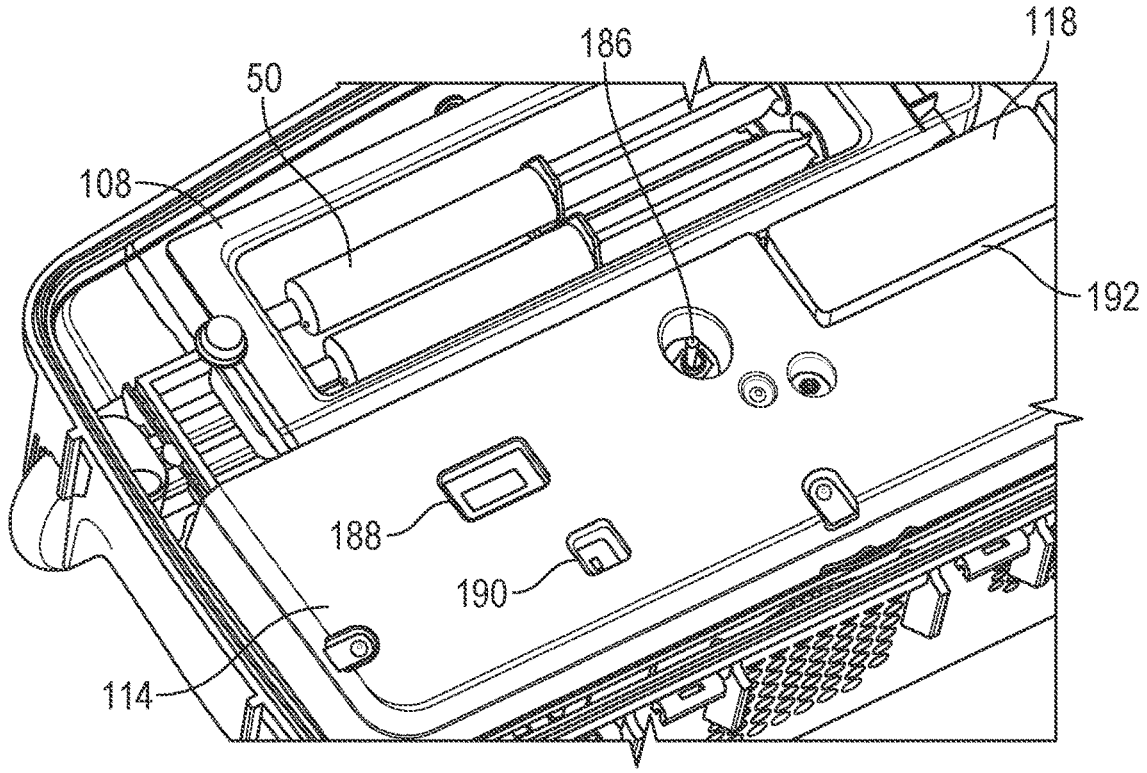
FIG. 9 illustrates an isometric view of a portion of a transportable device.

FIG. 9 illustrates an isometric view of a portion of the transportable device 100. FIG. 9 shows that the controls cover 114 can include several openings, cutouts, or windows. For example, the controls cover 114 can include a cutout for access to a power switch 186. The controls cover can also include windows 188 and 190 to view a battery level indicator and a charging light, respectively. The controls cover 114 can also include a cutout for the data or cellular transceiver 118 such that the transceiver can be removed and replaced without removal of the controls cover 114.

Figure 10:
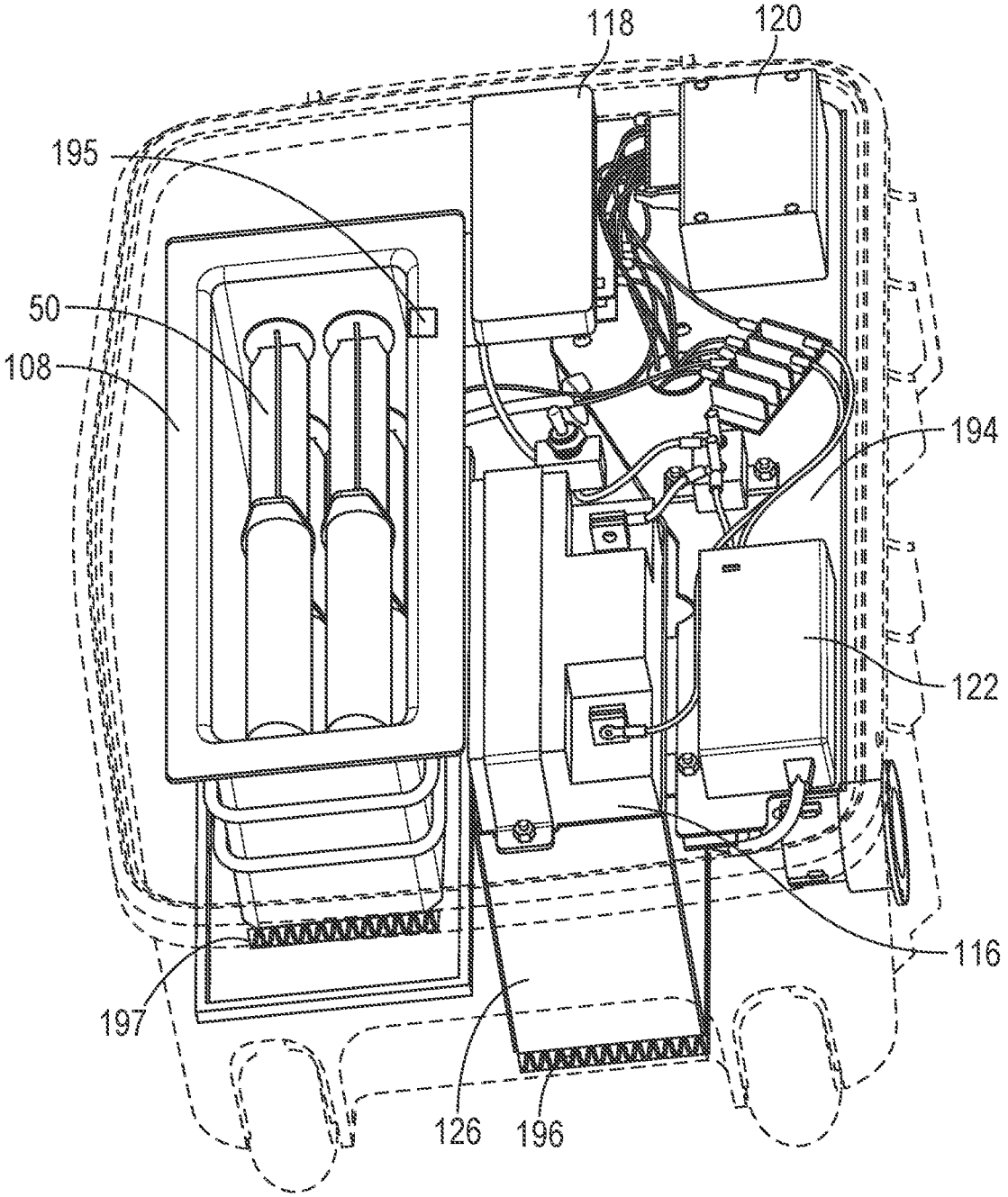
FIG. 10 illustrates an isometric view of a portion of a transportable device.

FIG. 10 illustrates an isometric view of a portion of the transportable device 100. FIG. 10 shows that the device 100 can include a controls support 194, which can be a panel or support configured to support the controls devices, such as the controller 120, the cellular transceiver 118, and the transformer 122.

FIG. 10 also shows that a shock absorber 196 can be positioned between the power source housing 126 and the housing 102. The shock absorber 196 can be a VIP or can have a shape of a gyroid. The shock absorber 196 can be configured to help protect the power source 116 from external forces and shocks. Similarly, a shock absorber 197 can be positioned between the container 108 and the housing 102. The shock absorber 197 can be a VIP or can have a shape of a gyroid. The shock absorber 197 can be configured to help protect the container from external forces and shocks.

FIG. 10 also shows a thermal probe 195 that can be connected to or positioned within the container 108. The thermal probe 195 can be a temperature sensor, such as a thermistor, thermocouple, resistive temperature detector (RTD), or the like. The thermal probe 195 can be connected to the controller 122 to transmit a temperature signal thereto. The controller 122 can receive the signal from the temperature probe 195 and can control the heater 144 or the cooling system 125 based on the temperature signal such as to maintain the desired temperature within the container 108.

Figure 11:
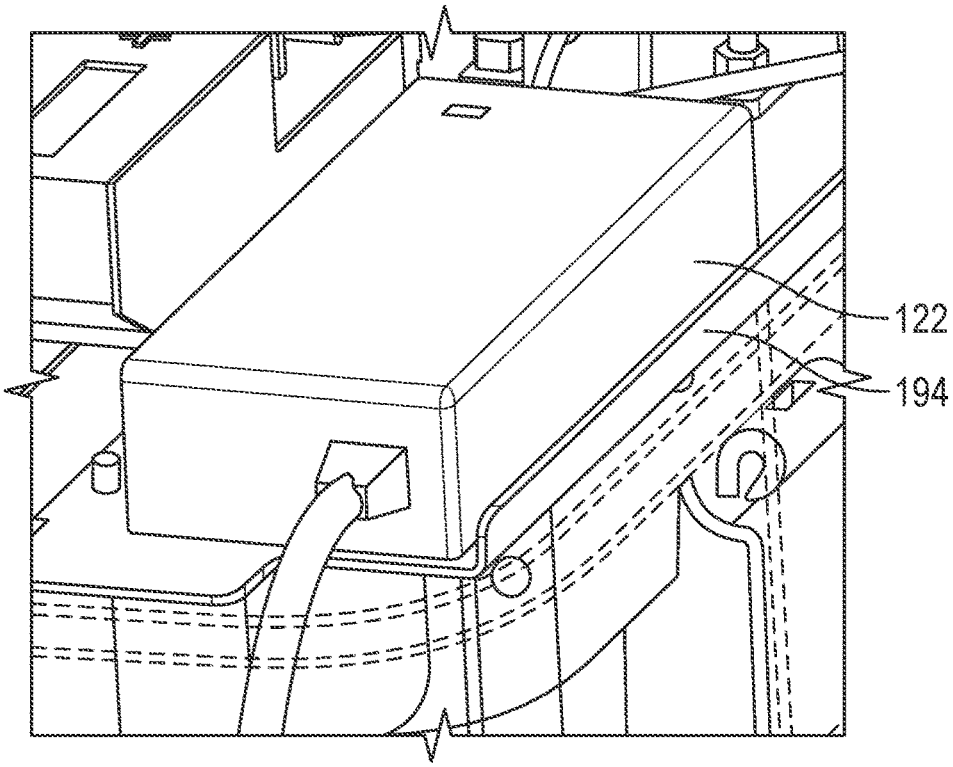
FIG. 11 illustrates an isometric view of a portion of a transportable device.
Figure 12:
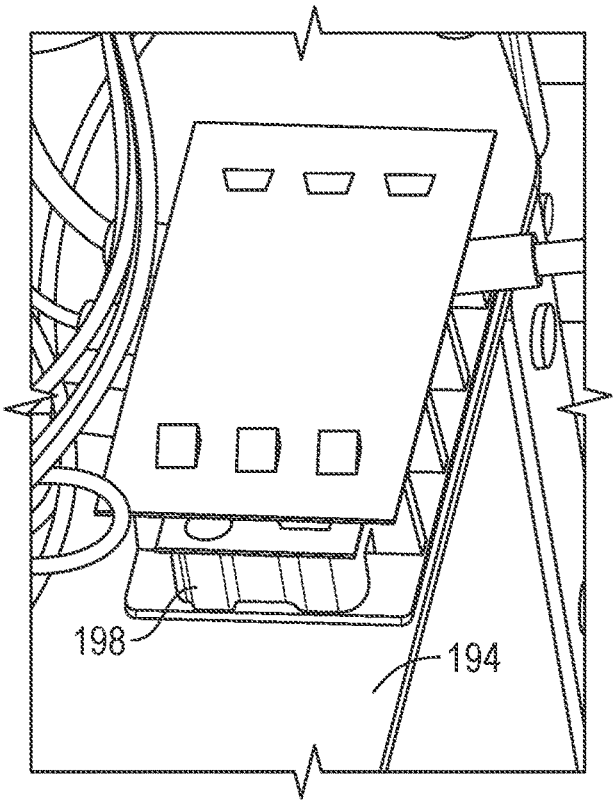
FIG. 12 illustrates an isometric view of a portion of a transportable device.

FIG. 11 illustrates an isometric view of a portion of the transportable device 100. As shown in FIG. 12, a transformer 122 can be mounted directly to the controls support 194 to allow the controls support 194 to act as a heat spreader for the transformer 122, which can help to keep the transformer 122 in a desired operating temperature window. That is, the controls support 194 can help prevent the transformer 122 from overheating such as during charging operations.

FIG. 12 illustrates an isometric view of a portion of the transportable device 100. As shown in FIG. 11, a motor controller 198 can be mounted directly to the controls support 194 to allow the controls support 194 to act as a heat spreader for the motor controller 198, which can help to keep the motor controller 198 in a desired operating temperature window. That is, the heat controls support 194 can help prevent the motor controller 198 from overheating such as during operation of the fan 134 and the compressor 148 during cooling operations.

Figure 13A:
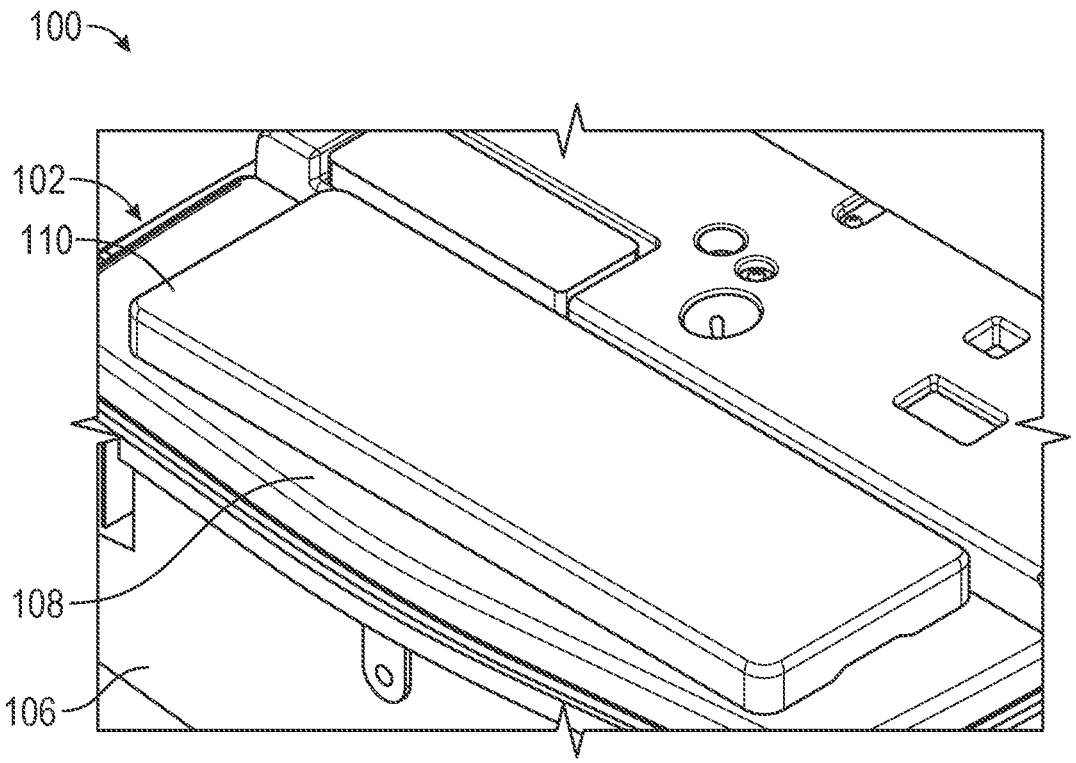
FIG. 13A illustrates an isometric view of a portion of a transportable device.
Figure 13B:
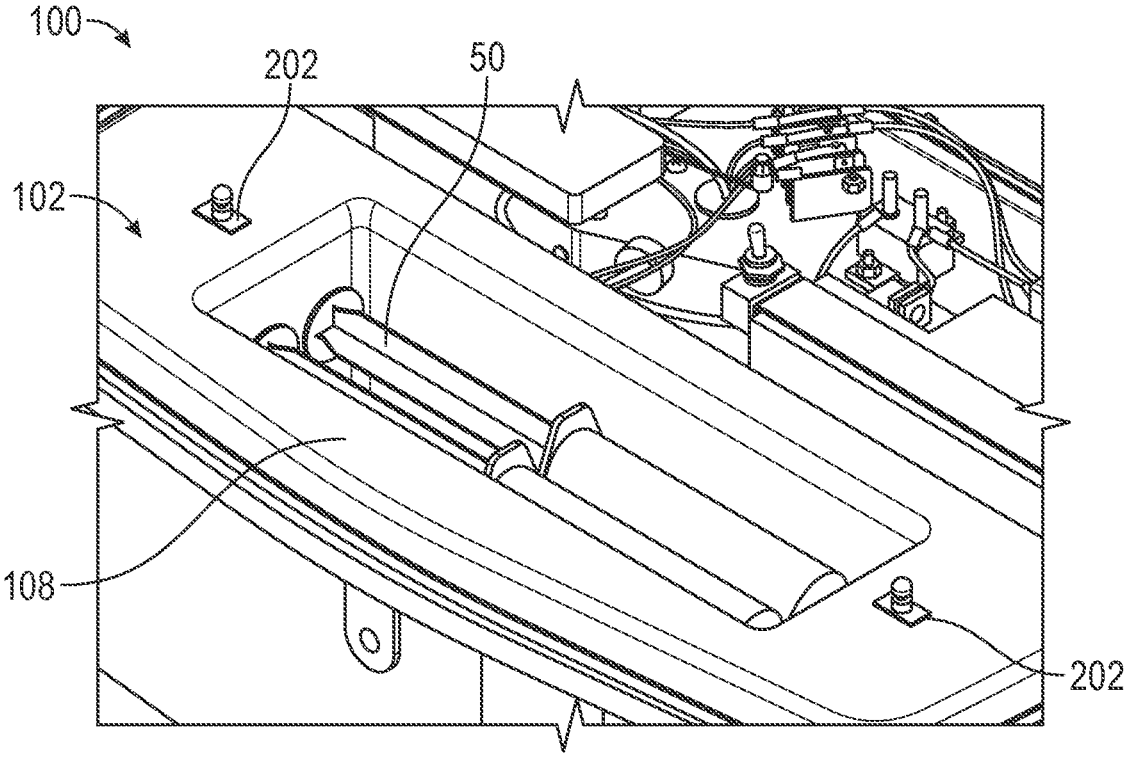
FIG. 13B illustrates an isometric view of a portion of a transportable device.
Figure 13C:
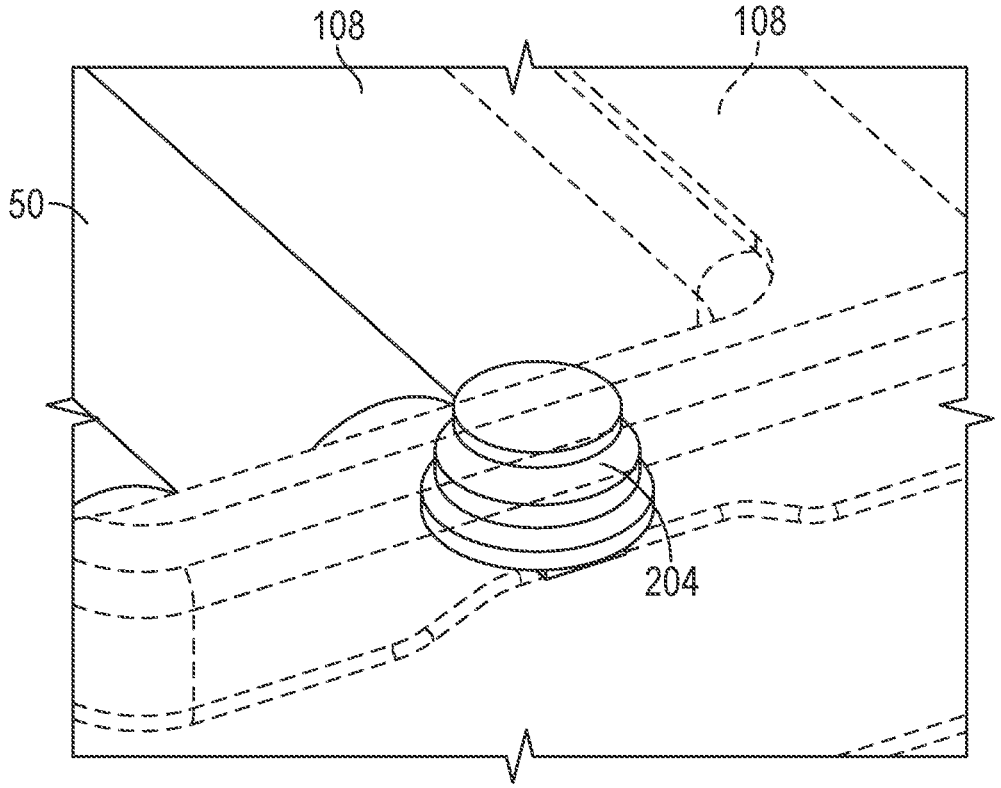
FIG. 13C illustrates an isometric view of a portion of a transportable device.
Figure 13D:
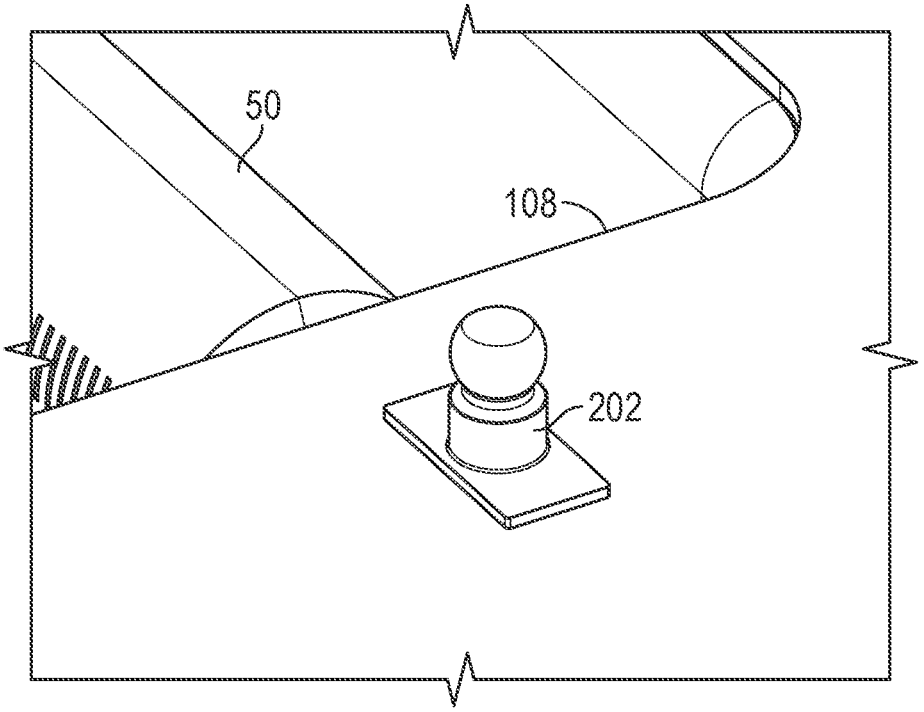
FIG. 13D illustrates an isometric view of a portion of a transportable device.

FIG. 13A illustrates an isometric view of a portion of the transportable device 100. FIG. 13B illustrates an isometric view of a portion of the transportable device 100. FIG. 13C illustrates an isometric view of a portion of the transportable device 100. FIG. 13D illustrates an isometric view of a portion of the transportable device 100. FIGS. 13A-13D are discussed below together.

FIG. 13A shows the container lid 110 secured to the housing 102 and positioned over the container 108. FIG. 13B shows the container lid 110 removed from the housing 102 to expose the container 108 and its contents, such as the samples 50. FIG. 13B also shows ball mounts 202 connected to the container 108 or connected to the housing 102 near the container 108. FIG. 13C shows the container lid 110 in phantom such that a socket 204 is visible. FIG. 13D shows the container lid 110 removed to more clearly show one of the ball mounts 202.

The ball mounts 202 can be secured to the container 108 and configured to releasably connect or secure to the sockets 204. The sockets 204 can be secured to the container lid 110 such that when the sockets 204 are secured to the ball mounts 202, the container lid 110 is secured to the ball mounts 202 and therefore the container lid 110 is secured to the container 108 and the housing 102. When it is desired to access the samples 50 or the contents of the container 108, the container lid 110 can be pulled in a direction away from the ball mounts 202 to disconnect the sockets 204 from the ball mounts 202 and therefore the container lid 110 from the container 108 and the housing 102.

Figure 14:
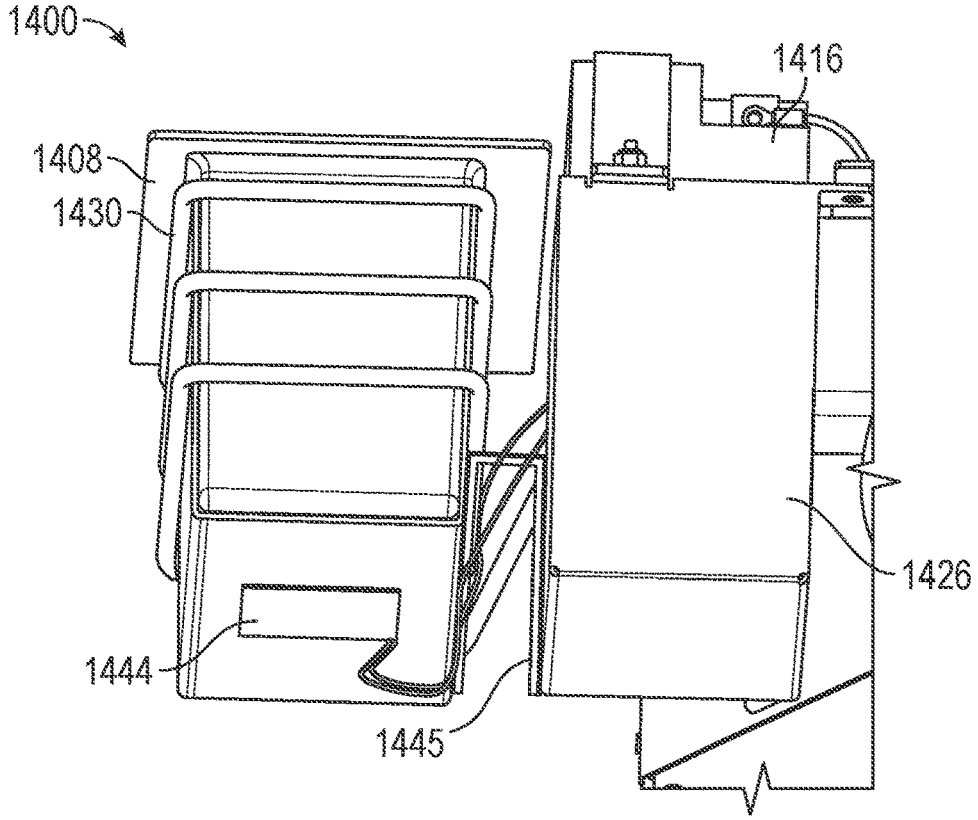
FIG. 14 illustrates an isometric view of a portion of a transportable device.

FIG. 14 illustrates an isometric view of a portion of a transportable device 1400. The transportable device 1400 can be similar to the transportable device 100 discussed above. The transportable device 1400 can include a container 1408, a power source 1416, a power source housing 1426, an evaporator 1430, a heater 1444, and a power supply heat spreader 1445.

The power supply heat spreader 1445 can be connected to the power supply housing or enclosure 1426 and the power supply heat spreader 1445 can be configured to exchange heat between the power supply 1416, the evaporator 1430, and the heater 1444 to help ensure that the power supply 1416 stays within a desired or working temperature window during use and transportation of the transportation device. In some examples, the header spreader 1445 can be a heat pipe.

Figure 15:
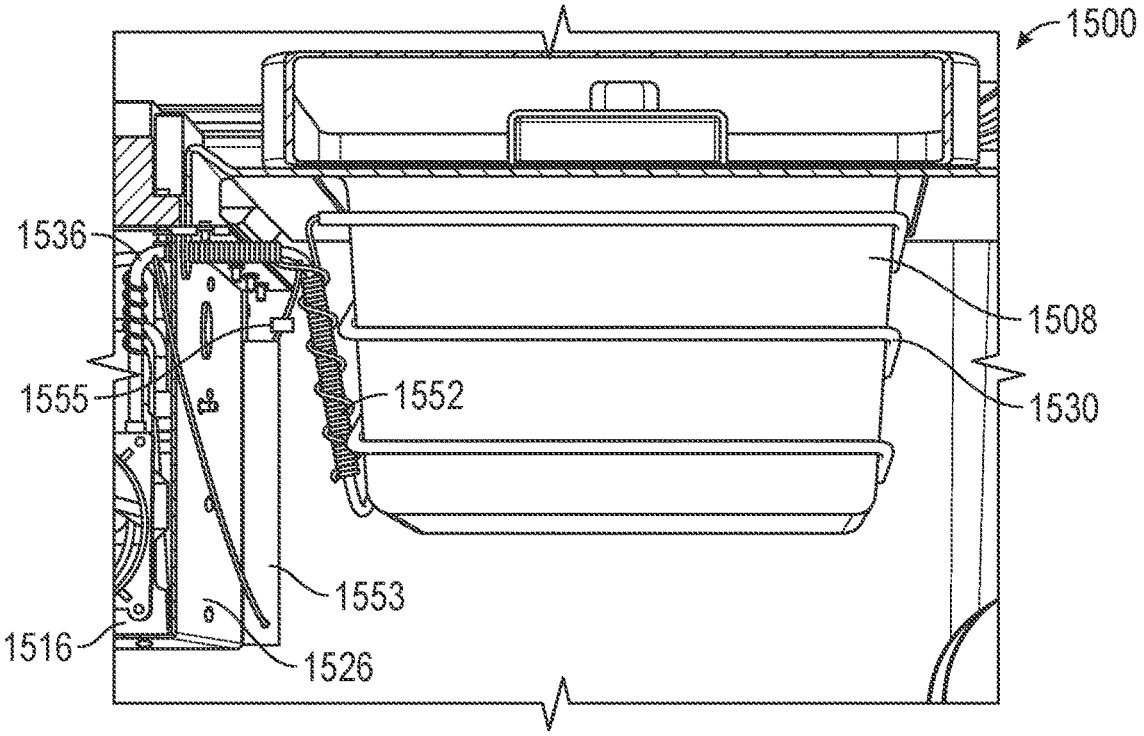
FIG. 15 illustrates an isometric view of a portion of a transportable device.

FIG. 15 illustrates an isometric view of a portion of a transportable device 1500. The transportable device 1500 can be similar to the transportable device 100 discussed above. The transportable device 1500 can include a container 1508, an evaporator 1530, a suction line 1536, a capillary tube 1552, a power source heat exchanger 1553, and a control valve 1555.

FIG. 15 shows how the capillary tube 1552 (which can be connected to the condenser and the evaporator 1530) can be wrapped around the suction line 1536. Because the capillary tube 1552 can be wrapped around the suction line 1536 many times, the suction line 1536 and the capillary tube 1552 can be configured to exchange heat. That is, a liquid-to-suction heat exchanger can be formed, which can allow suction gas within the suction line 1536 to be further heated by warm liquid in the capillary tube 1552, which helps to cool the refrigerant in the capillary tube 1552. This can help prevent the compressor from being slugged with liquid refrigerant and can help increase cooling capacity of the evaporator 1530 for a given condensing temperature.

FIG. 15 also shows how the power source heat exchanger 1553 can be positioned near or adjacent the power source 1516 (such as by being connected to the power source housing 1526). The power source heat exchanger 1553 can be a coil, such as a cooling coil, and can be fluidly connected to capillary tube 1552 (or can be connected to the suction line 1536 downstream of the evaporator). The power source heat exchanger 1553 configured to cool the power source 1516 using refrigerant leaving the evaporator 1530. In some examples, the control valve 1555 can be connected to the power source heat exchanger 1553 and can be operated by a controller (such as the controller 120) to divert refrigerant around the power source heat exchanger 1553 when power source cooling is not required. Similarly, the control valve 1555 can be operated to direct refrigerant to the power source heat exchanger 1553 when the power source 1516 requires cooling.

Figure 16:
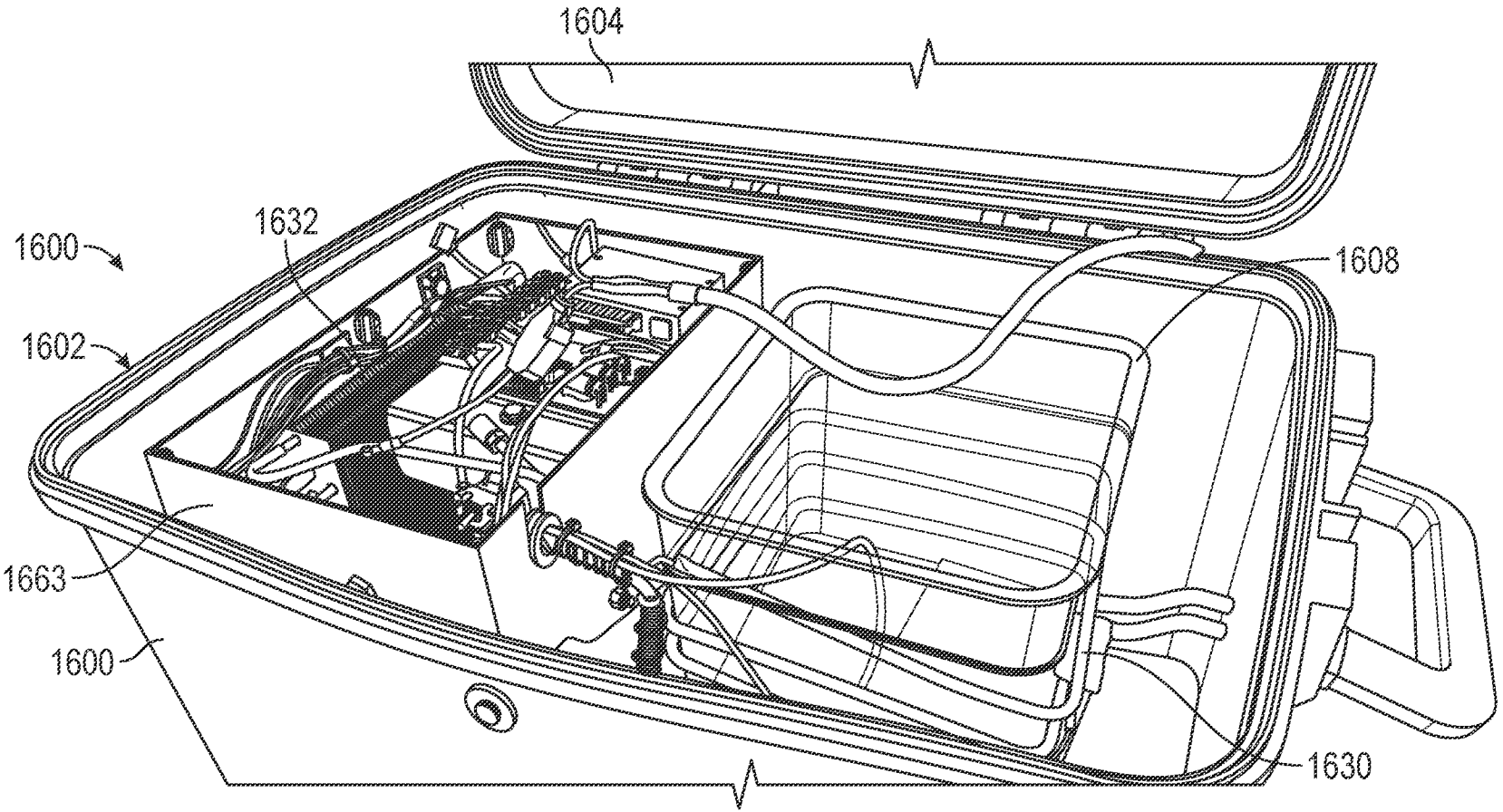
FIG. 16 illustrates a perspective view of a transportable device.
Figure 17:
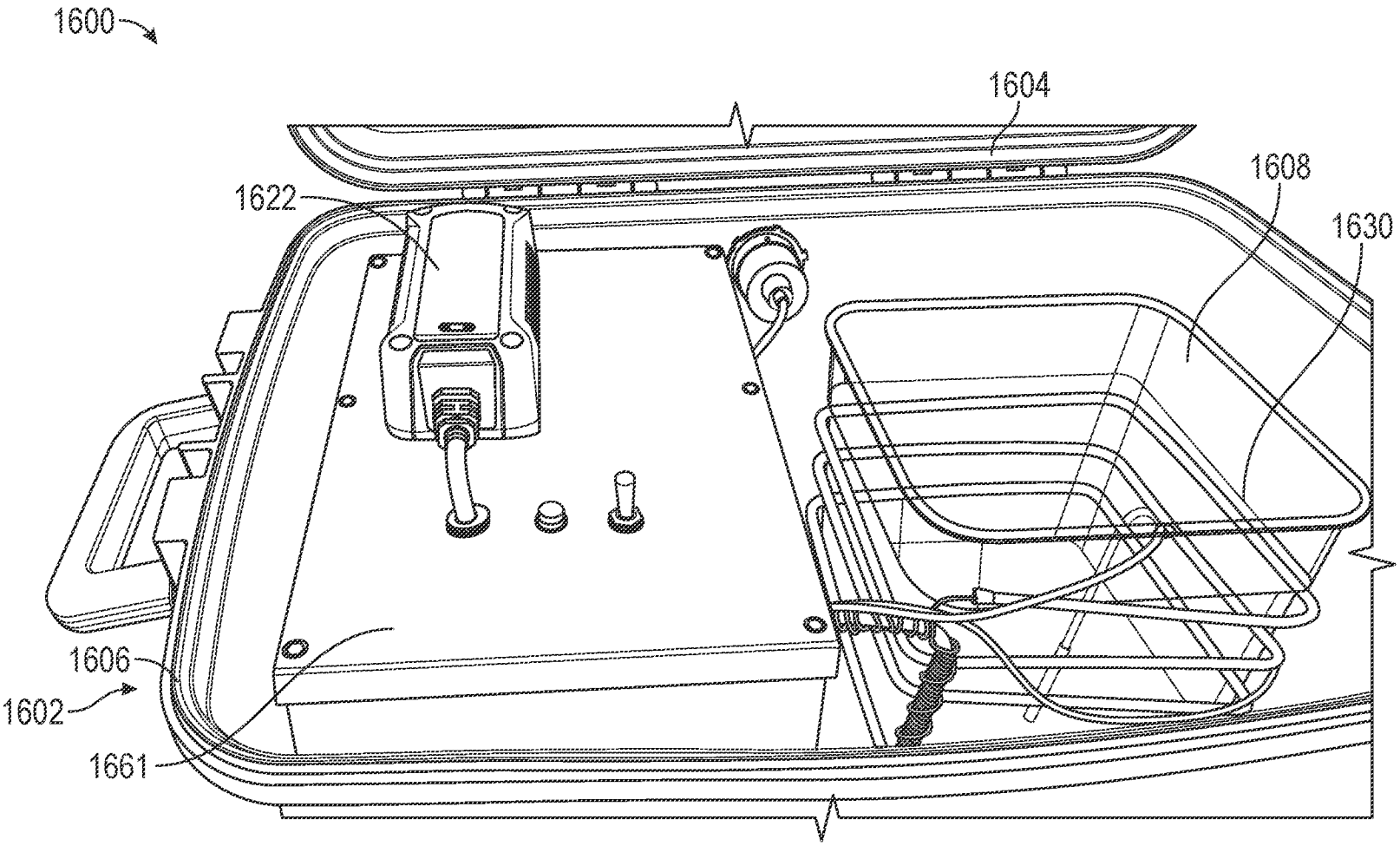
FIG. 17 illustrates a perspective view of a transportable device.
Figure 18:
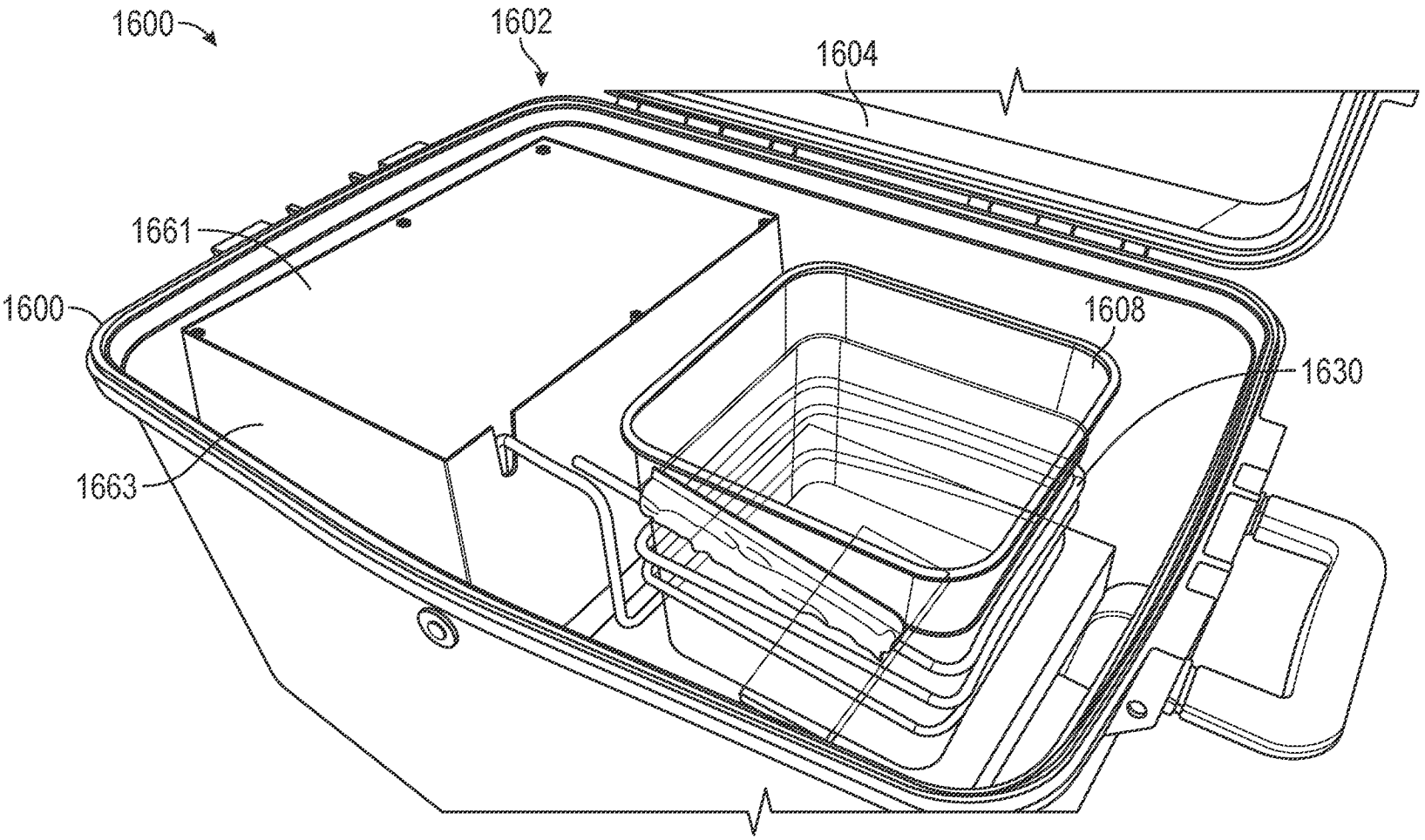
FIG. 18 illustrates a perspective view of a portion of a transportable device.

FIG. 16 illustrates a perspective view of a transportable device 1600. FIG. 17 illustrates a perspective view of the transportable device 1600. FIG. 18 illustrates a perspective view of a portion of the transportable device 1600. FIGS. 16-18 are discussed together below.

The transportable device 1600 can be similar to those discussed above. The transportable device 1600 can include a housing 1602 including a lid 1604 and a base 1606. A container 1608 can be surrounded, at least in part, by an evaporator 1630 connected to a condenser 1632.

FIG. 16 shows a cover 1661 of an internal housing 1663 removed and FIG. 17 shows the cover 1661 secured to the housing 1663 with a transformer 1622 secured to the cover 1661. The housing 1663 can separate mechanical components, such as the condenser 1632 and a compressor from the container 1608.

Figure 19:
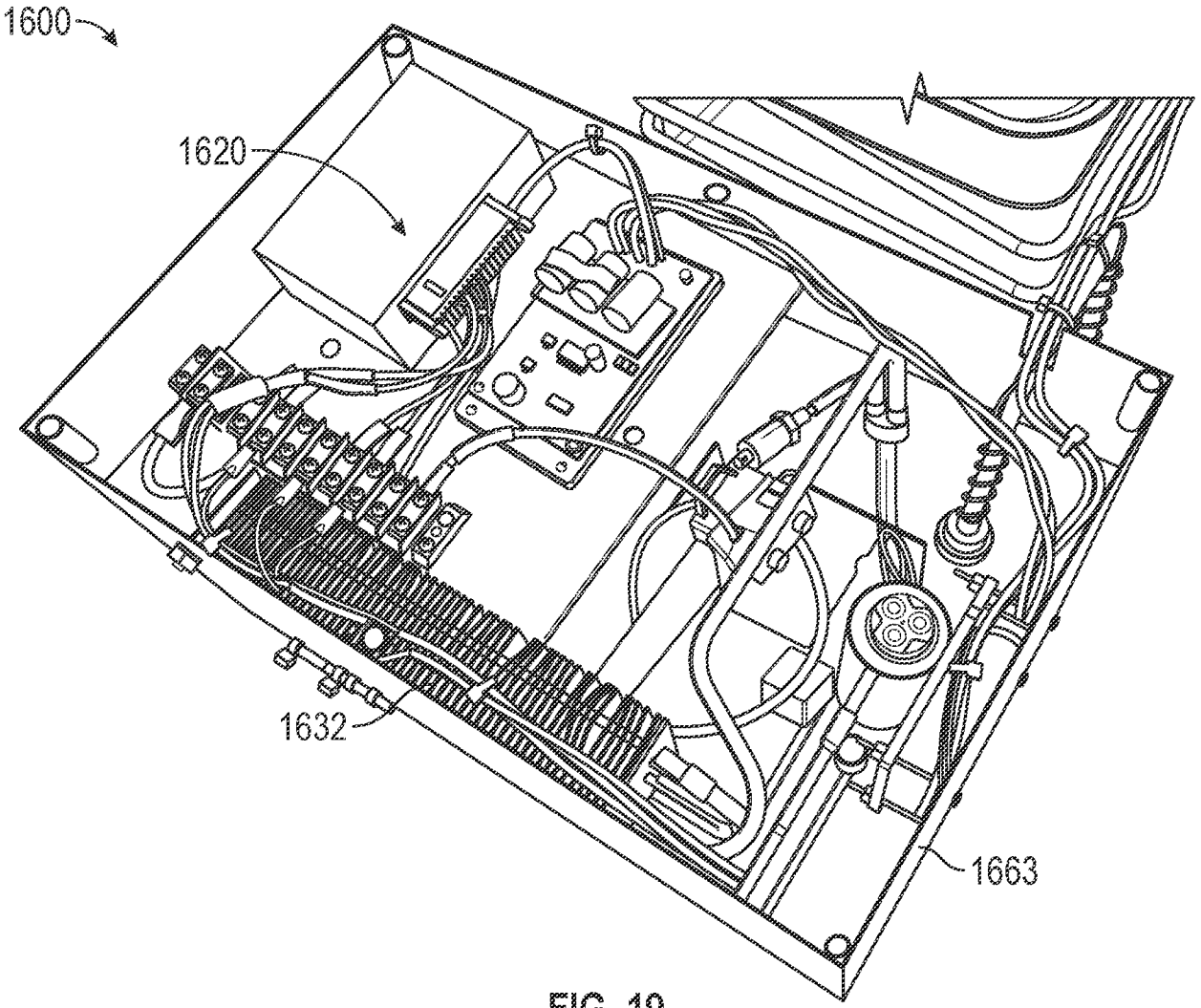
FIG. 19 illustrates a perspective view of a portion of a transportable device.

FIG. 19 illustrates a perspective view of a portion of the transportable device 1600. FIG. 19 shows that the internal housing 1663 can support the condenser 1632 and the controls and electrical components 1620.

Figure 20:
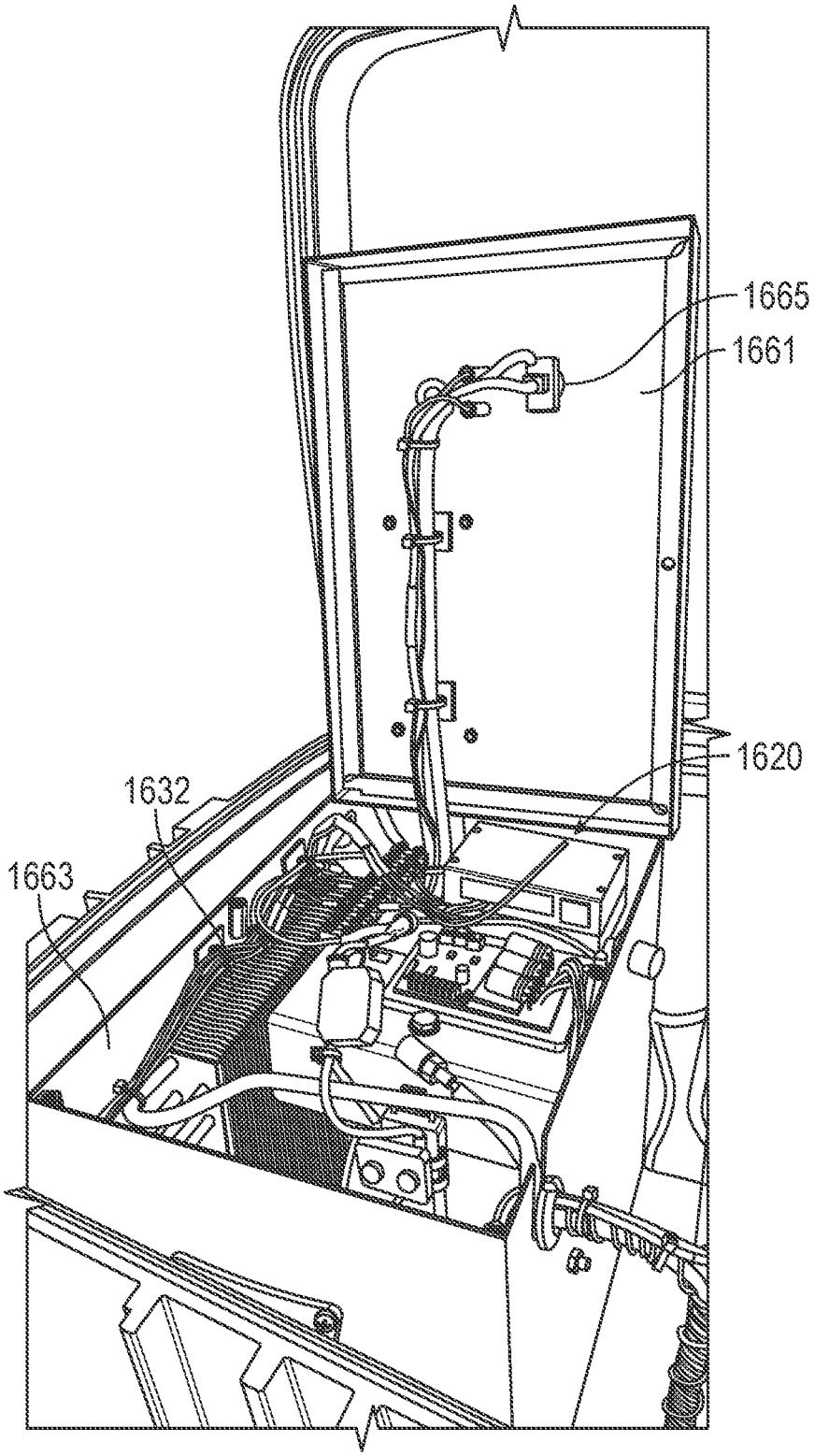
FIG. 20 illustrates a perspective view of a portion of a transportable device.
Figure 21:
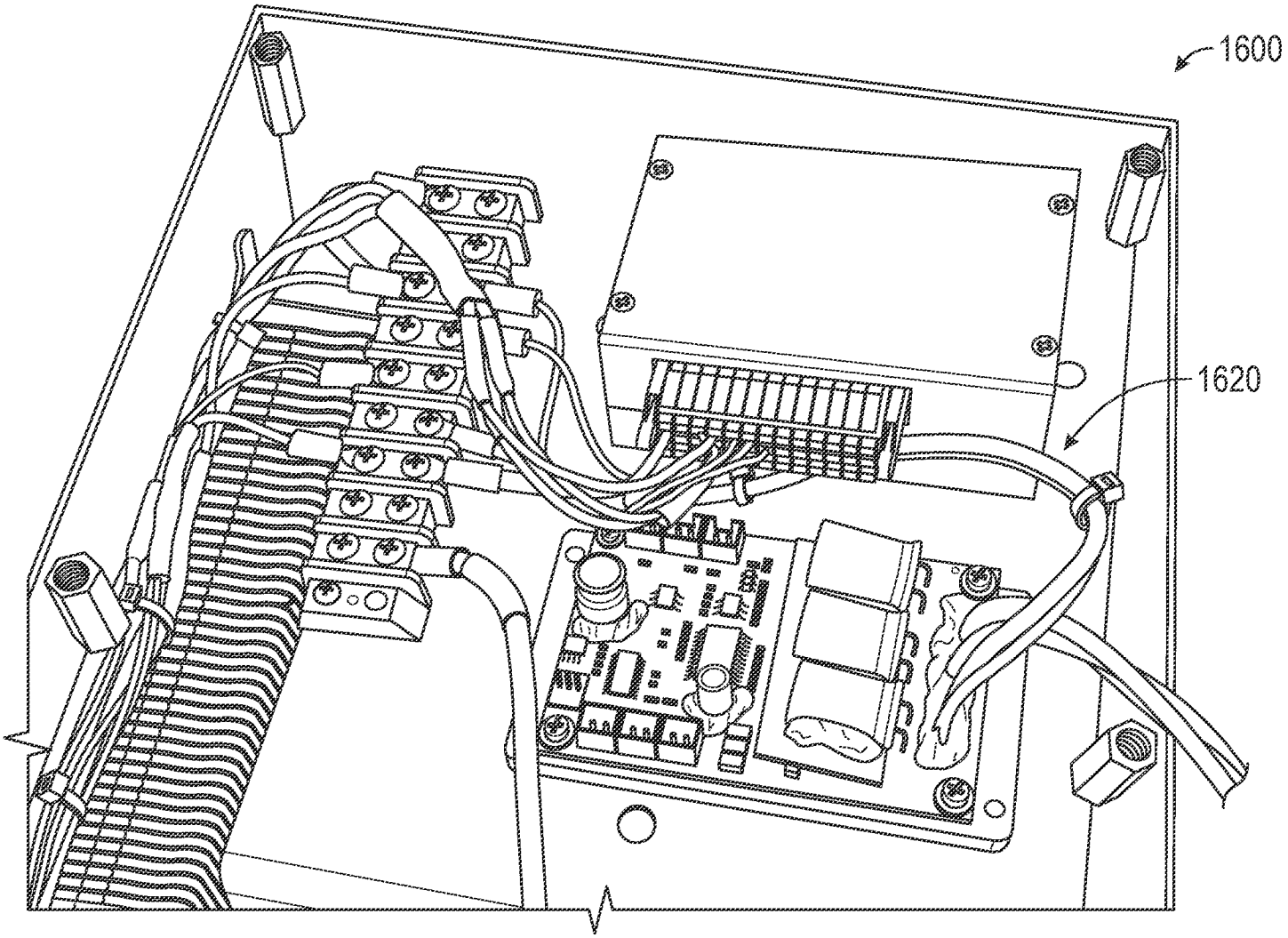
FIG. 21 illustrates a perspective view of a portion of a transportable device.

FIG. 20 illustrates a perspective view of a portion of the transportable device 1600 and shows how the power switch can extend through the cover 1661 and can connect to controls components within the housing 1663. FIG. 21 illustrates a perspective view of a portion of the transportable device 1600 and shows various controls components located therein, such as a controller and terminals.

Figure 22:
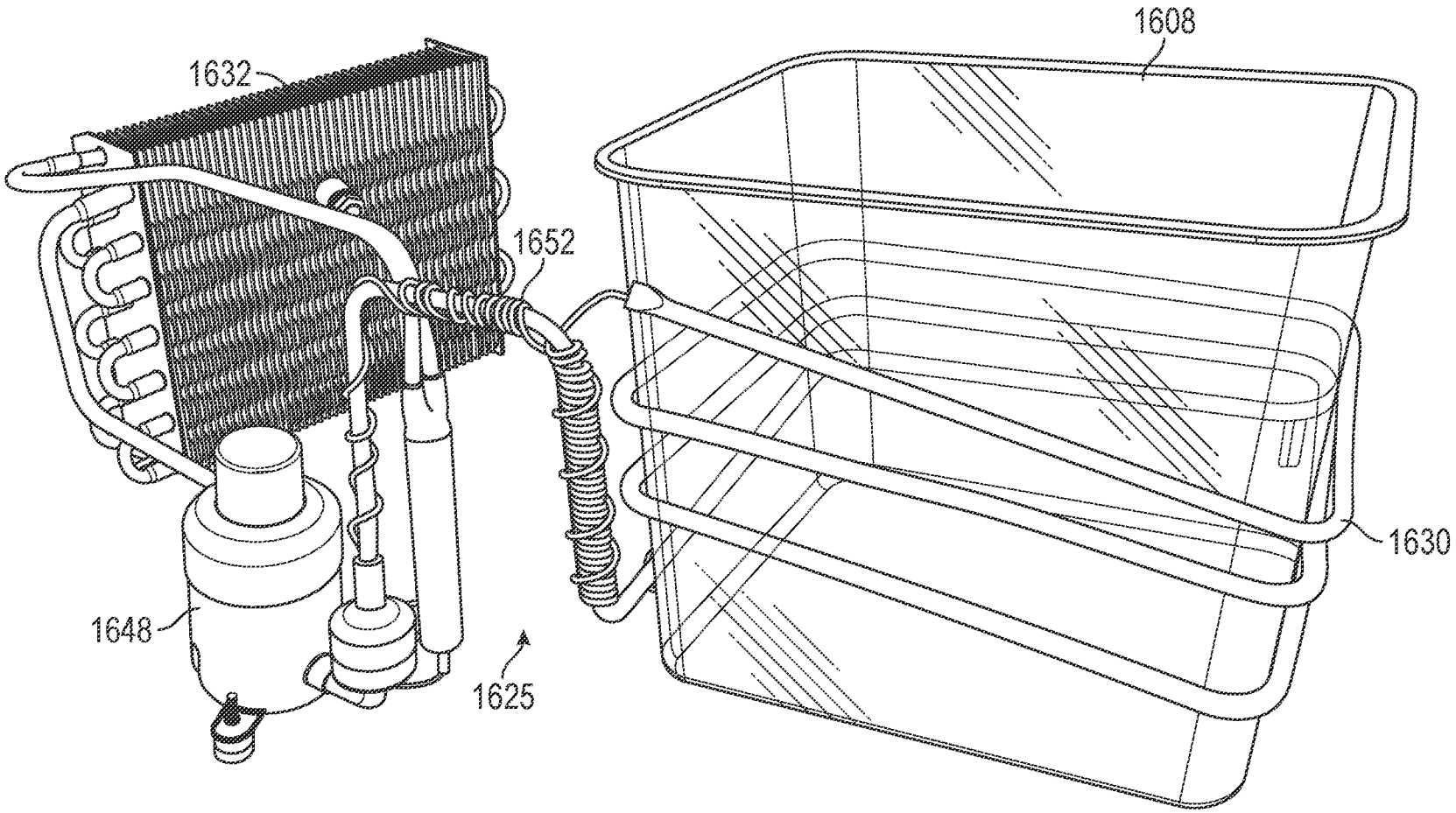
FIG. 22 illustrates a perspective view of a cooling system of a transportable device.
Figure 23:
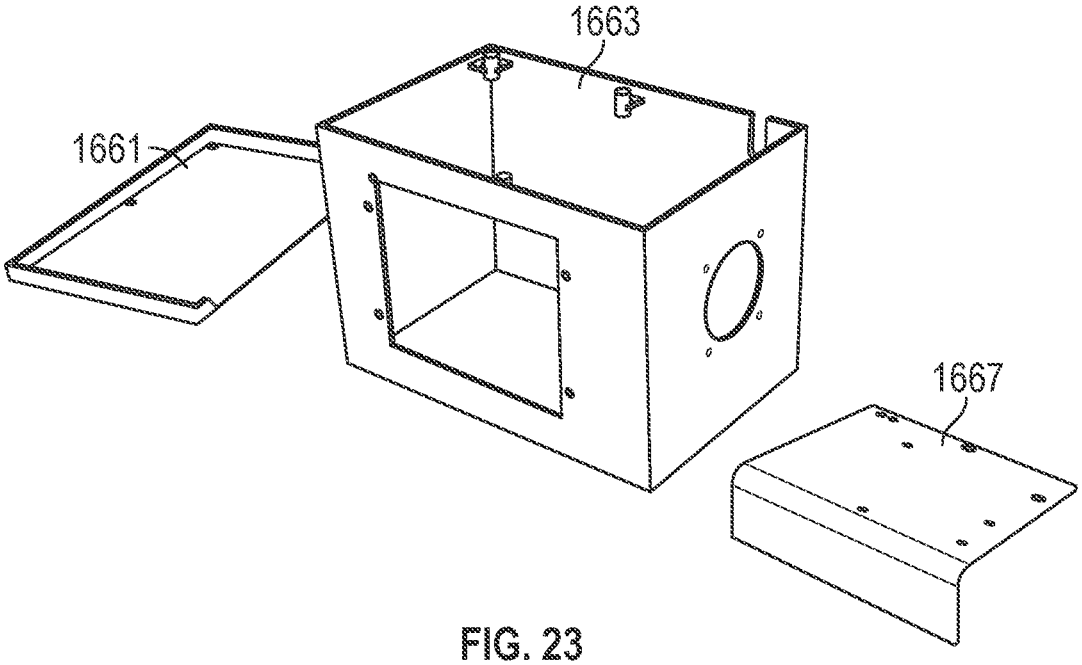
FIG. 23 illustrates a perspective view of an internal housing of a transportable device.

FIG. 22 illustrates a perspective view of a cooling system 1625 of the transportable device 1600, which can include an evaporator 1630, a condenser 1632, a compressor 1648, and an expansion device 1652 (such as a capillary tube). FIG. 23 illustrates a perspective view of the internal housing 1663 including covers 1661 and 1667.

Figure 24:
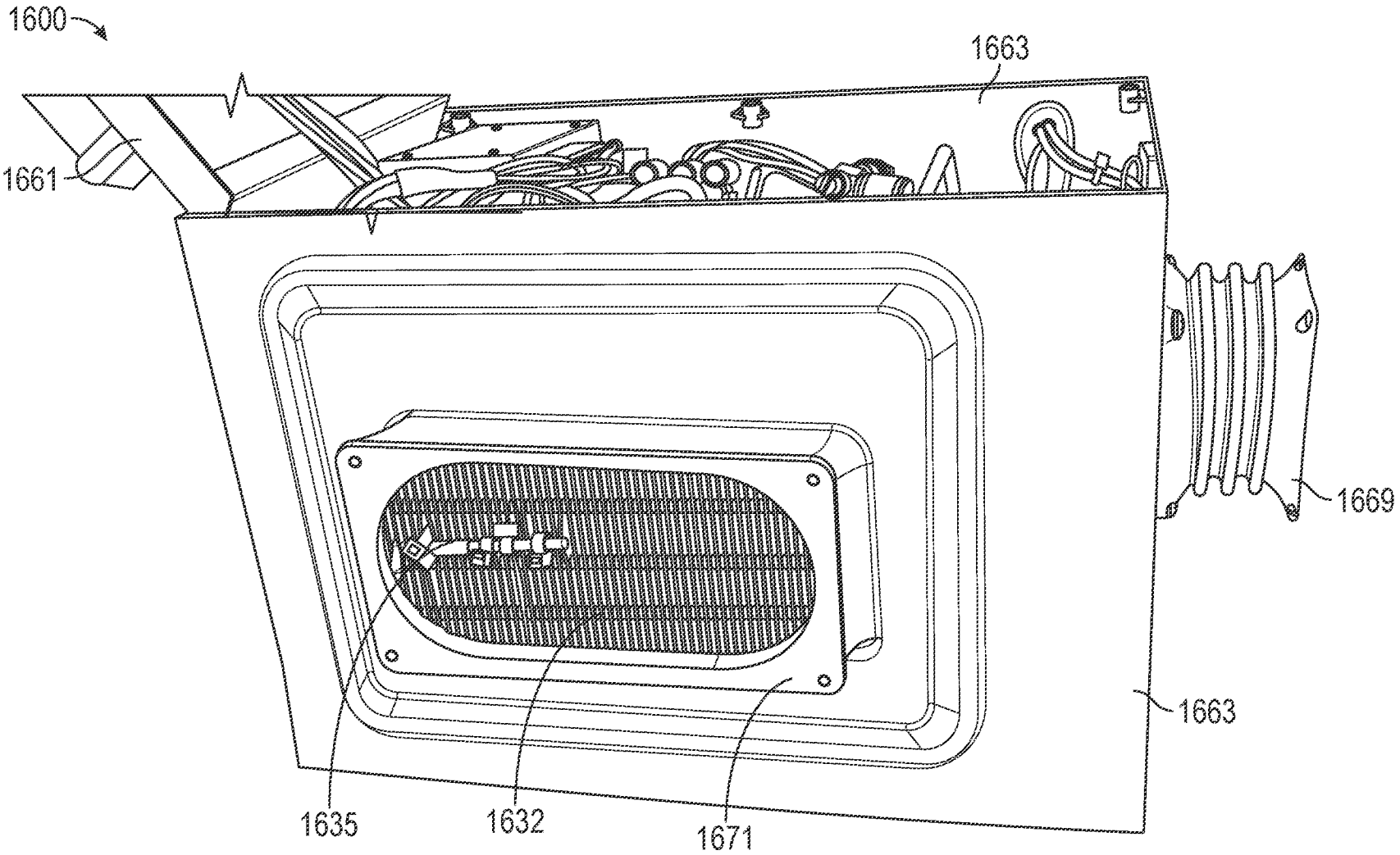
FIG. 24 illustrates a perspective view of a portion of a transportable device.
Figure 25:
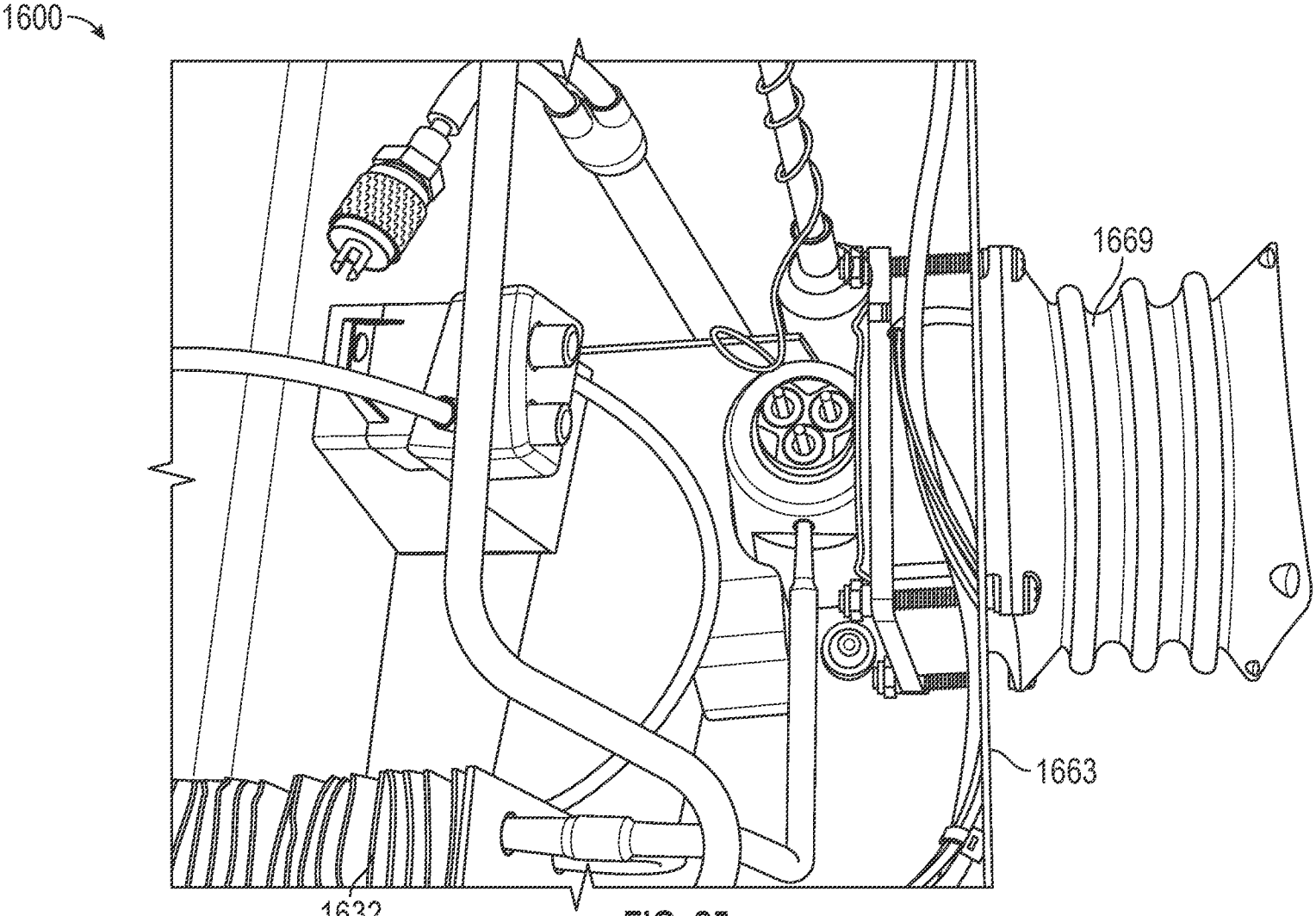
FIG. 25 illustrates a perspective view of a portion of a transportable device.

FIG. 24 illustrates a perspective view of a portion of the transportable device 1600. FIG. 25 illustrates a perspective view of a portion of the transportable device 1600. FIGS. 24 and 25 are discussed together below.

FIGS. 24 and 25 show that the transportable device 1600 can include a first bellows 1669 and a second bellows 1671. The first bellows 1669 can be connected to the housing 1663 and to the housing 1602 (shown in FIG. 18). The bellows 1669 can be configured to direct air transfer between the condenser and the ambient environment. Similarly, the second bellows 1671 can be a bellows transition located between the condenser 1632 and the housing 1602. The bellows can be positioned to direct air into or out of the condenser coil 1632 (depending on the configuration of the condenser fan). In some examples, the second bellows 1671 can be manufactured using three-dimensional printing.

FIG. 24 also shows a thermistor 1635, which can be any temperature sensor and can be located on or adjacent to the condenser 1632. The thermistor 1635 can be connected to a controller, such as the controller 120, and can be configured to transmit a condenser temperature sensor thereto. The controller can use the temperature sensor to operate the condenser fan and the compressor of the device 1602, such as to optimize the cooling system for efficiency and given ambient conditions.

Notes and Examples

The following, non-limiting examples, detail certain aspects of the present subject matter to solve the challenges and provide the benefits discussed herein, among others.

Example 1 is a transportable enclosure for actively controlling a temperature of a temperature-sensitive item, the transportable enclosure comprising: a housing including a lid; a container positionable within the housing and configured to receive and retain the temperature sensitive item therein; an evaporator extending at least partially around the container; a condenser located near a wall of the housing and configured to reject heat from the evaporator to an ambient environment through an opening in the wall of the housing; a compressor to circulate refrigerant between the evaporator and the condenser; and a controller configured to operate the compressor to maintain a desired temperature within the container.

In Example 2, the subject matter of Example 1 optionally includes a heater connected to the container to heat the container.

In Example 3, the subject matter of Example 2 optionally includes wherein the controller is configured to operate the heater to maintain the desired temperature within the container.

In Example 4, the subject matter of anyone or more of Examples 1-3 optionally include a heat spreader at least partially surrounding the container.

In Example 5, the subject matter of Example 4 optionally includes a heater connected to the heat spreader and configured to heat the heat spreader.

In Example 6, the subject matter of Example 5 optionally includes wherein the heat spreader is shaped complementary to the container.

In Example 7, the subject matter of anyone or more of Examples 5-6 optionally include wherein at least a portion of the evaporator is brazed to the heat spreader.

In Example 8, the subject matter of any one or more of Examples 5-7 optionally include a power supply enclosure supporting the power supply; and a power supply heat spreader connected to the power supply enclosure and the heat spreader to exchange heat between the power supply, the evaporator, and the heater.

In Example 9, the subject matter of anyone or more of Examples 5-8 optionally include a filter drier connected to a liquid line downstream of the condenser, the filter drier oriented to be thirty degrees from vertical with respect to the housing.

Example 10 is a transportable enclosure for actively controlling a temperature of a temperature-sensitive item, the transportable enclosure comprising: a housing including a lid; a container positionable within the housing and configured to receive and retain the temperature sensitive item therein; an evaporator extending at least partially around the container; a condenser located near a wall of the housing and configured to reject heat from the evaporator to an ambient environment through an opening in the wall of the housing; a compressor to circulate refrigerant between the evaporator and the condenser; a condenser fan located within the housing to deliver ambient air to the condenser; a heater connected to the container to heat the container; and a controller configured to operate the compressor and the heater to maintain a desired temperature within the container.

In Example 11, the subject matter of Example 10 optionally includes a plurality of vacuum insulated panels positioned within the housing and at least partially around the container, the evaporator, and the heater.

In Example 12, the subject matter of anyone or more of Examples 10-11 optionally include wherein the housing comprises a plurality of intake bores and a plurality of exhaust bores extending through a wall of the housing.

In Example 13, the subject matter of Example 12 optionally includes wherein the exhaust bores extend through the wall of the housing such that the exhaust bores are configured to discharge exhaust air from the housing in a direction away from the intake bores.

In Example 14, the subject matter of Example 13 optionally includes wherein the intake bores extend through the wall of the housing such that the intake bores are configured to intake ambient air into the housing in a direction away from the exhaust bores.

In Example 15, the subject matter of anyone or more of Examples 12-14 optionally include wherein the housing includes a spacer fin extending outward from the wall of the housing, the spacer fin positioned between the intake bores and the exhaust bores.

In Example 16, the subject matter of anyone or more of Examples 12-15 optionally include wherein the housing includes a spacer fin extending outward from the wall of the housing, the spacer fin positioned laterally outward of the intake bores and including a bore extending therethrough to allow exhaust air to pass through the fin.

Example 17 is a transportable enclosure for actively controlling a temperature of a temperature-sensitive item, the transportable enclosure comprising: a housing including a lid; a rechargeable power source secured to the housing; a container positionable within the housing and configured to receive and retain the temperature sensitive item therein; an evaporator extending at least partially around the container; a condenser located near a wall of the housing and configured to reject heat from the evaporator to an ambient environment through an opening in the wall of the housing; a compressor powered by the power source to circulate refrigerant between the evaporator and the condenser; and a controller powered by the power source and configured to operate the compressor to maintain a desired temperature within the container.

In Example 18, the subject matter of Example 17 optionally includes a shock absorber positioned between the housing and the container.

In Example 19, the subject matter of Example 18 optionally includes wherein at least a portion of the shock absorber has a geometric shape of a gyroid.

In Example 20, the subject matter of any one or more of Examples 18-19 optionally include wherein the shock absorber includes: a first shock absorber having a geometric shape of a gyroid having a first Shore value; and a second shock absorber having a geometric shape of a gyroid having a second Shore value that is different from the first Shore value.

In Example 21, the subject matter of anyone or more of Examples 17-20 optionally include a power source heat exchanger positioned near the power source and fluidly connected to and downstream of the evaporator, the power source heat exchanger configured to cool the power source using refrigerant leaving the evaporator.

In Example 22, the subject matter of any one or more of Examples 17-21 optionally include a bellows connected to the condenser and connected to a wall of the housing to direct air transfer between the condenser and the ambient environment.

In Example 23, the subject matter of any one or more of Examples 17-22 optionally include a suction line connected to the evaporator and the compressor; and a capillary tube connected to the condenser and to the evaporator, the capillary tube wrapped around the suction line in a helical manner to form a liquid to suction heat exchanger.

In Example 24, the subject matter of any one or more of Examples 17-23 optionally include a container lid positionable over the container; and a ball mount connected to the container; and a socket connected to the lid, the socket engageable with the ball mount to releasably secure the container lid to the container.

In Example 25, the subject matter of any one or more of Examples 17-24 optionally include a power source housing connected to the power source and the container, the power source housing positioned to support the power source; and a power source shock absorber positioned between the power source housing and the container.

In Example 26, the subject matter of any one or more of Examples 17-25 optionally include a mechanical housing connected to the compressor and the container, the mechanical housing positioned to support the compressor; and a mechanical shock absorber positioned between the mechanical housing and the container.

Example 27 is a transportable enclosure comprising: a housing including a lid; a power source secured to the housing; a container configured to receive a temperature sensitive item therein; an evaporator disposed at least partially around the container; a condenser positioned near a wall of the housing and configured to reject heat from the evaporator to an ambient environment through the wall of the housing; a compressor powered by the power source to circulate refrigerant between the evaporator and the condenser; a controller powered by the power source and configured to operate the compressor to maintain a desired temperature within the container.

In Example 28, the subject matter of Example 27 optionally includes a heater located near the container and powered by the power source to provide heat to the container, wherein the controller is configured to operate the heater to maintain the desired temperature within the container.

In Example 29, the subject matter of any one or more of Examples 27-28 optionally include a condenser fan located within the housing and powered by the power supply to deliver ambient air to the condenser.

In Example 30, the subject matter of anyone or more of Examples 27-29 optionally include a power source heat exchanger positioned near the power source and fluidly downstream of the evaporator, the power source heat exchanger configured to cool the power source using refrigerant leaving the evaporator.

In Example 31, the subject matter of Example 30 optionally includes an internal housing, the power source located within the internal housing and the power source heat exchanger positioned within the internal housing.

In Example 32, the subject matter of any one or more of Examples 27-31 optionally include a bellows located between the condenser and the housing.

In Example 33 the apparatuses or method of any one or any combination of Examples 1-32 can optionally be configured such that all elements or options recited are available to use or select from.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A transportable enclosure for actively controlling a temperature of a temperature-sensitive item, the transportable enclosure comprising:

a housing including a lid;

a container positionable within the housing and configured to receive and retain the temperature sensitive item therein;

an evaporator extending at least partially around the container;

a condenser located near a wall of the housing and configured to reject heat from the evaporator to an ambient environment through an opening in the wall of the housing;

a power supply enclosure supporting a power supply;

a power supply heat spreader connected to the power supply enclosure and a heat spreader to exchange heat between the power supply, the evaporator, and a heater;

a compressor to circulate a refrigerant between the evaporator and the condenser; and a controller configured to operate the compressor to maintain a temperature setpoint within the container.

2. The Transportable enclosure of claim 1, further comprising:

the heater connected to the container to heat the container.

3. The transportable enclosure of claim 2, wherein the controller is configured to operate the heater to maintain the temperature setpoint within the container.

4. The transportable enclosure of claim 1, further comprising:

the heat spreader at least partially surrounding the container.

5. The transportable enclosure of claim 4, further comprising:

the heater connected to the heat spreader and configured to heat the heat spreader.

6. The transportable enclosure of claim 5, wherein the heat spreader is shaped complementary to the container.

7. The transportable enclosure of claim 5, wherein the evaporator surrounds at least a portion of the heat spreader and at least a portion of the evaporator is directly connected to the heat spreader.

8. The transportable enclosure of claim 5, further comprising:

a filter drier connected to a liquid line downstream of the condenser, the filter drier oriented to be thirty degrees from vertical with respect to the housing.

9. A transportable enclosure for actively controlling a temperature of a temperature-sensitive item, the transportable enclosure comprising:

a housing including a lid, the housing including:

a plurality of intake bores and a plurality of exhaust bores extending through a wall of the housing; and a spacer fin extending outward from the wall of the housing, the spacer fin positioned between the intake bores and the exhaust bores;

a container positionable within the housing and configured to receive and retain the temperature sensitive item therein;

an evaporator extending at least partially around the container;

a condenser located near a wall of the housing and configured to reject heat from the evaporator to an ambient environment through an opening in the wall of the housing;

a compressor to circulate refrigerant between the evaporator and the condenser;

a condenser fan located within the housing to deliver ambient air to the condenser;

a heater connected to the container to heat the container; and a controller configured to operate the compressor and the heater to maintain a temperature setpoint within the container.

10. The transportable enclosure of claim 9, further comprising:

a plurality of vacuum insulated panels positioned within the housing and at least partially around the container, the evaporator, and the heater.

11. The transportable enclosure of claim 9, wherein the exhaust bores extend through the wall of the housing such that the exhaust bores are configured to discharge exhaust air from the housing in a direction away from the intake bores.

12. The transportable enclosure of claim 11, wherein the intake bores extend through the wall of the housing such that the intake bores are configured to intake the ambient air into the housing in a direction away from the exhaust bores.

13. The transportable enclosure of claim 9, wherein the housing includes a spacer fin extending outward from the wall of the housing, the spacer fin positioned laterally outward of the intake bores and including a plurality of bores extending therethrough to allow the exhaust air to pass through the spacer fin.

14. A transportable enclosure for actively controlling a temperature of a temperature-sensitive item, the transportable enclosure comprising:

a housing including a lid;

a rechargeable power source secured to the housing;

a container positionable within the housing and configured to receive and retain the temperature sensitive item therein;

an evaporator extending at least partially around the container;

a condenser located near a wall of the housing and configured to reject heat from the evaporator to an ambient environment through an opening in the wall of the housing;

a shock absorber positioned between the housing and the container, the shock absorber including:

a first shock absorber having a geometric shape of a first gyroid; and a second shock absorber having a geometric shape of a second gyroid that is different from the first gyroid;

a compressor powered by the power source to circulate a refrigerant between the evaporator and the condenser; and a controller powered by the power source and configured to operate the compressor to maintain a temperature setpoint within the container.

* * * * *